US011235591B2

(12) United States Patent
Ishida et al.

(10) Patent No.: US 11,235,591 B2
(45) Date of Patent: Feb. 1, 2022

(54) IMAGE FORMING APPARATUS AND IMAGE FORMING APPARATUS BODY

(71) Applicants: Masatoshi Ishida, Kanagawa (JP); Kunihiko Nishioka, Kanagawa (JP); Yohei Osanai, Kanagawa (JP); Satoshi Narai, Kanagawa (JP); Tomoya Fujii, Kanagawa (JP); Takayuki Andoh, Kanagawa (JP); Masashi Ota, Kanagawa (JP); Munekazu Hirata, Tokyo (JP)

(72) Inventors: Masatoshi Ishida, Kanagawa (JP); Kunihiko Nishioka, Kanagawa (JP); Yohei Osanai, Kanagawa (JP); Satoshi Narai, Kanagawa (JP); Tomoya Fujii, Kanagawa (JP); Takayuki Andoh, Kanagawa (JP); Masashi Ota, Kanagawa (JP); Munekazu Hirata, Tokyo (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 16/567,521

(22) Filed: Sep. 11, 2019

(65) Prior Publication Data

US 2020/0101763 A1 Apr. 2, 2020

(30) Foreign Application Priority Data

Sep. 28, 2018 (JP) ..... JP2018-185154
Nov. 27, 2018 (JP) ..... JP2018-221292

(51) Int. Cl.

| | |
|---|---|
| ***B41J 3/36*** | (2006.01) |
| ***B41J 3/37*** | (2006.01) |
| ***B41J 3/39*** | (2006.01) |

(52) U.S. Cl.
CPC . *B41J 3/36* (2013.01); *B41J 3/37* (2013.01); *B41J 3/39* (2013.01)

(58) Field of Classification Search
CPC ..... B41J 2/175; B41J 3/36; B41J 3/37; B41J 3/39
See application file for complete search history.

(56) References Cited

U.S. PATENT DOCUMENTS 6,302,535 B1 * 10/2001 Sturgeon ..... B41J 2/17503 347/86
6,502,917 B1 * 1/2003 Shinada ..... B41J 2/17523 347/19

(Continued)

FOREIGN PATENT DOCUMENTS

EP 0379151 A2 7/1990
EP 1259380 B1 10/2004

(Continued)

OTHER PUBLICATIONS

U.S. Appl. No. 16/243,423, filed Jan. 9, 2019 Toshikane Nishii, et al.

(Continued)

*Primary Examiner* — Anh T Vo
(74) *Attorney, Agent, or Firm* — Harness, Dickey & Pierce, P.L.C.

(57) ABSTRACT

An image forming apparatus includes a recording device and an apparatus body to internally house the recording device. The apparatus body includes an attachment unit to be removably mounted in the apparatus body and an apparatus body-side connector. The attachment unit includes an attachment-side connector to be electrically connected to the apparatus body-side connector. The apparatus body also includes a pressing portion to press the attachment unit in a direction in which the attachment-side connector faces the apparatus body-side connector in a state where the attach- (Continued)

ment unit is attached to the apparatus body. The direction is orthogonal to a mounting direction of the attachment unit. The apparatus body further includes a movable member holding the pressing portion movable between a first position where the pressing portion is closest to the apparatus body-side connector and a second position where the pressing portion is farthest from the apparatus body-side connector.

22 Claims, 32 Drawing Sheets

(56) References Cited

U.S. PATENT DOCUMENTS

| | | | | |
|---|---|---|---|---|
| 6,736,486 | B2 * | 5/2004 | Nakamura | B41J 2/1752 347/49 |
| 6,955,422 | B2 * | 10/2005 | Miyazawa | B41J 2/17509 347/86 |
| 7,008,053 | B2 * | 3/2006 | Hashii | B41J 2/1753 347/86 |
| 8,220,903 | B2 * | 7/2012 | Petruchik | B41J 2/17553 347/49 |
| 2003/0035026 | A1 | 2/2003 | Goin et al. | |
| 2009/0162082 | A1 | 6/2009 | Shiraki et al. | |
| 2012/0062685 | A1 | 3/2012 | Serizawa et al. | |
| 2012/0300007 | A1 | 11/2012 | Fujii et al. | |
| 2013/0188004 | A1 | 7/2013 | Arai et al. | |
| 2013/0194370 | A1 | 8/2013 | Sakaue et al. | |
| 2014/0369046 | A1 | 12/2014 | Andoh | |
| 2016/0214375 | A1 * | 7/2016 | Ikeda | B41J 3/36 |
| 2016/0352955 | A1 | 12/2016 | Ishida et al. | |
| 2017/0274644 | A1 * | 9/2017 | Shinohara | B41J 2/04508 |
| 2018/0361761 | A1 | 12/2018 | Okeguchi et al. | |

FOREIGN PATENT DOCUMENTS

| | | |
|---|---|---|
| EP | 2080620 A1 | 7/2009 |
| JP | 2001-315385 | 11/2001 |
| JP | 2008-012748 | 1/2008 |
| JP | 2019-001155 | 1/2019 |

OTHER PUBLICATIONS

U.S. Appl. No. 16/215,990, filed Dec. 11, 2018 Toshikane Nishii, et al.

U.S. Appl. No. 16/233,522, filed Dec. 27, 2018 Toshikane Nishii, et al.

Extended European Search Report dated Mar. 5, 2020 issued in corresponding European Application No. 19197053.2.

* cited by examiner

IMAGE FORMING APPARATUS AND IMAGE FORMING APPARATUS BODY

CROSS-REFERENCE TO RELATED APPLICATIONS

This patent application is based on and claims priority pursuant to 35 U.S.C. § 119(a) to Japanese Patent Application Nos. 2018-221292 and 2018-185154 filed on Nov. 27, 2018 and Sep. 28, 2018, respectively, in the Japan Patent Office, the entire disclosure of each of which is hereby incorporated by reference herein.

BACKGROUND

Technical Field

The present disclosure generally relates to an image forming apparatus and an image forming apparatus body.

Description of the Related Art

There are mobile image forming apparatuses including a recording device to record an image on a recording medium, an apparatus body that houses the recording device. The mobile image forming apparatus includes a recording device on a bottom face and is manually moved by the user on a recording medium. In the mobile image forming apparatus, a head cartridge that stores an ink tank is mounted in an apparatus body.

SUMMARY

An embodiment of this disclosure provides an image forming apparatus. The image forming apparatus includes a recording device configured to record an image on a recording medium and an apparatus body configured to internally house the recording device.

The apparatus body includes an attachment unit configured to be removably mounted in the apparatus body and an apparatus body-side connector. The attachment unit includes an attachment-side connector configured to be electrically connected to the apparatus body-side connector.

The apparatus body also includes a pressing portion configured to press the attachment unit in a facing direction in which the attachment-side connector faces the apparatus body-side connector in a state where the attachment unit is attached to the apparatus body. The facing direction is orthogonal to a mounting direction of the attachment unit. The apparatus body further includes a movable member holding the pressing portion and configured to move between a first position where the pressing portion is closest to the apparatus body-side connector and a second position where the pressing portion is farthest from the apparatus body-side connector.

Another embodiment provides an image forming apparatus body in which the attachment unit including the recording device is mounted. The apparatus body includes an attachment mount configured to house the attachment unit internally. The attachment mount includes the apparatus body-side connector described above. The image forming apparatus body further includes the pressing portion and the movable member described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
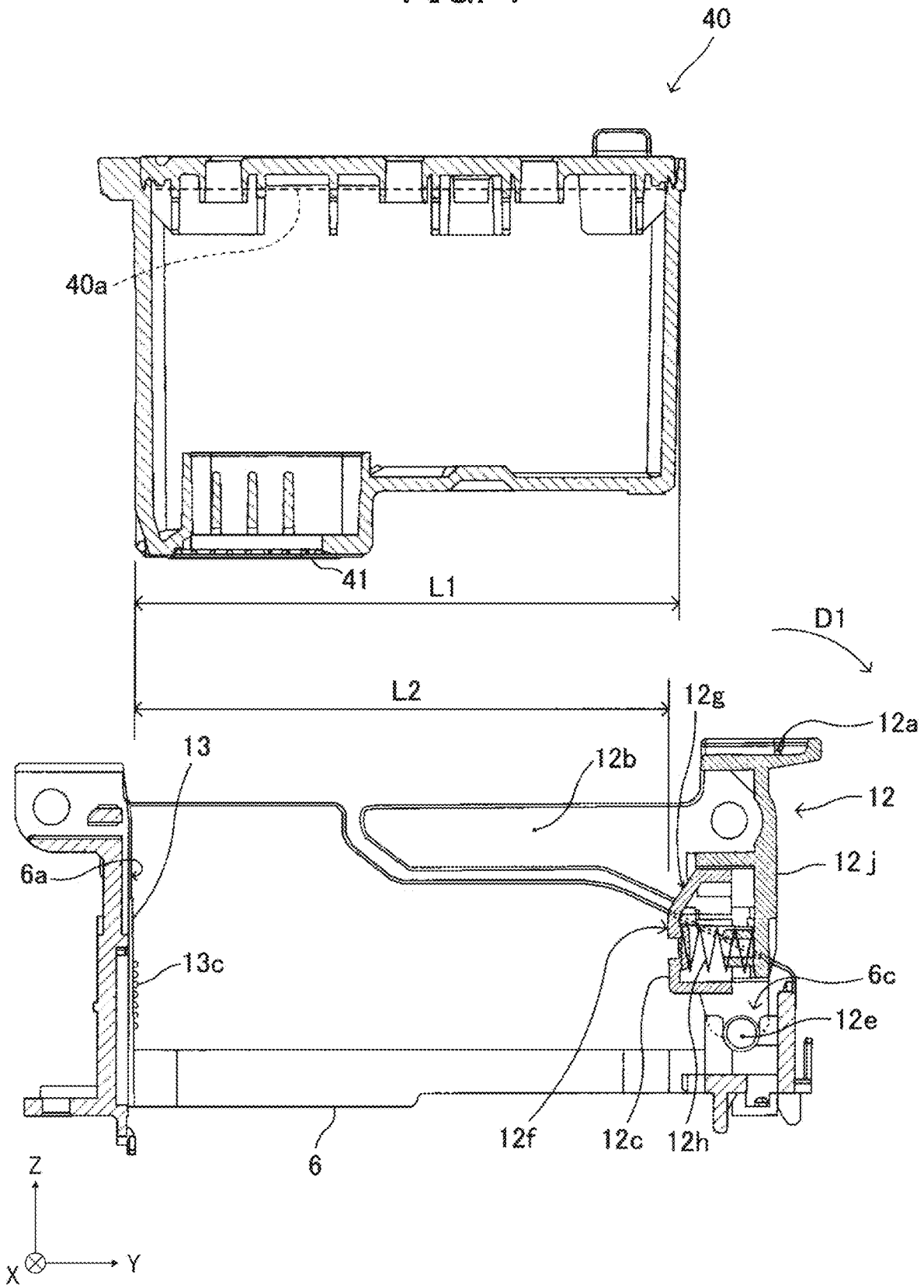
FIG. 1 is a cross-sectional view of a cartridge holder in a state where an ink cartridge is not mounted, a cartridge attaching and detaching mechanism and an ink cartridge according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of this disclosure is described. As used herein, the singular forms "a", "an", and "the" are intended to include the plural forms as well, unless the context clearly indicates otherwise.

The suffixes Y, M, C, and K attached to each reference numeral indicate only that components indicated thereby are used for forming yellow, magenta, cyan, and black images, respectively, and hereinafter may be omitted when color discrimination is not necessary.

Descriptions are given below of a handy (or handheld) mobile printer (hereinafter simply referred to as "handheld printer 1") that is a mobile image forming apparatus, according to an embodiment of the present disclosure. First, a basic configuration of the handheld printer 1 according to the embodiment is described.

Figure 2:
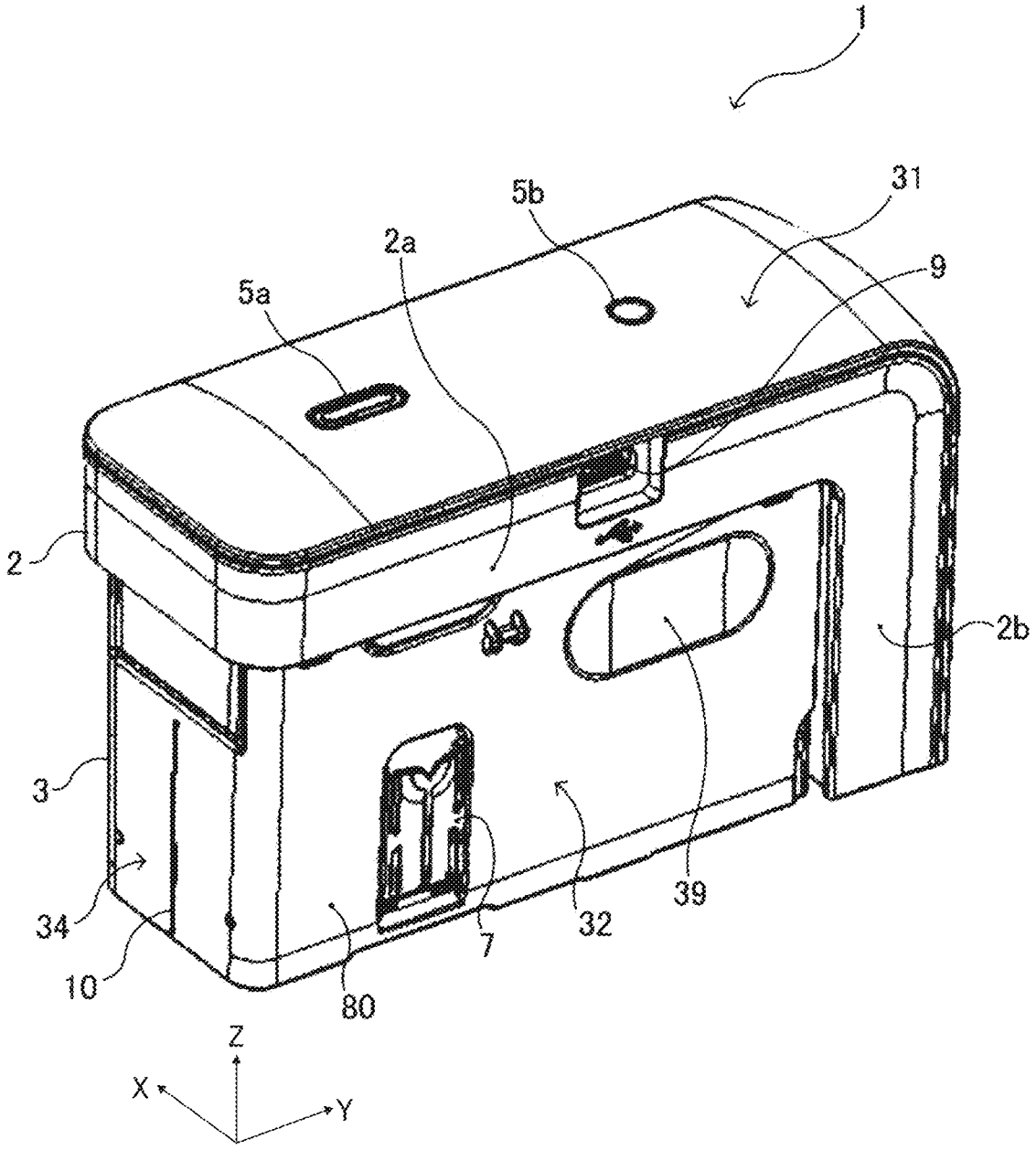
FIG. 2 is a perspective view illustrating an exterior of the handheld printer as viewed from above a rear left side of the handheld printer.
Figure 3:
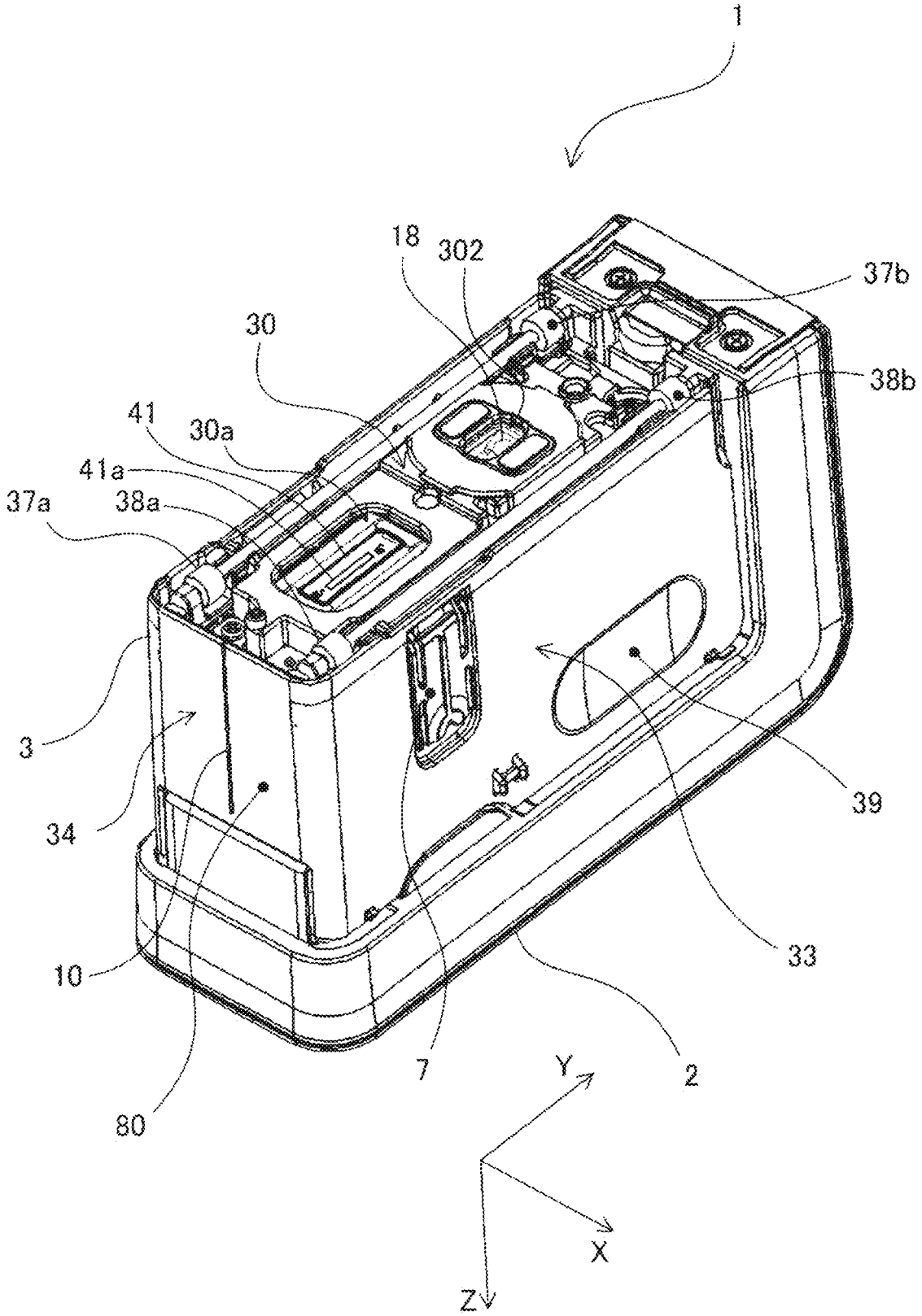
FIG. 3 is an exterior perspective view of a handheld printer as viewed from the lower right on the rear side.
Figure 4:
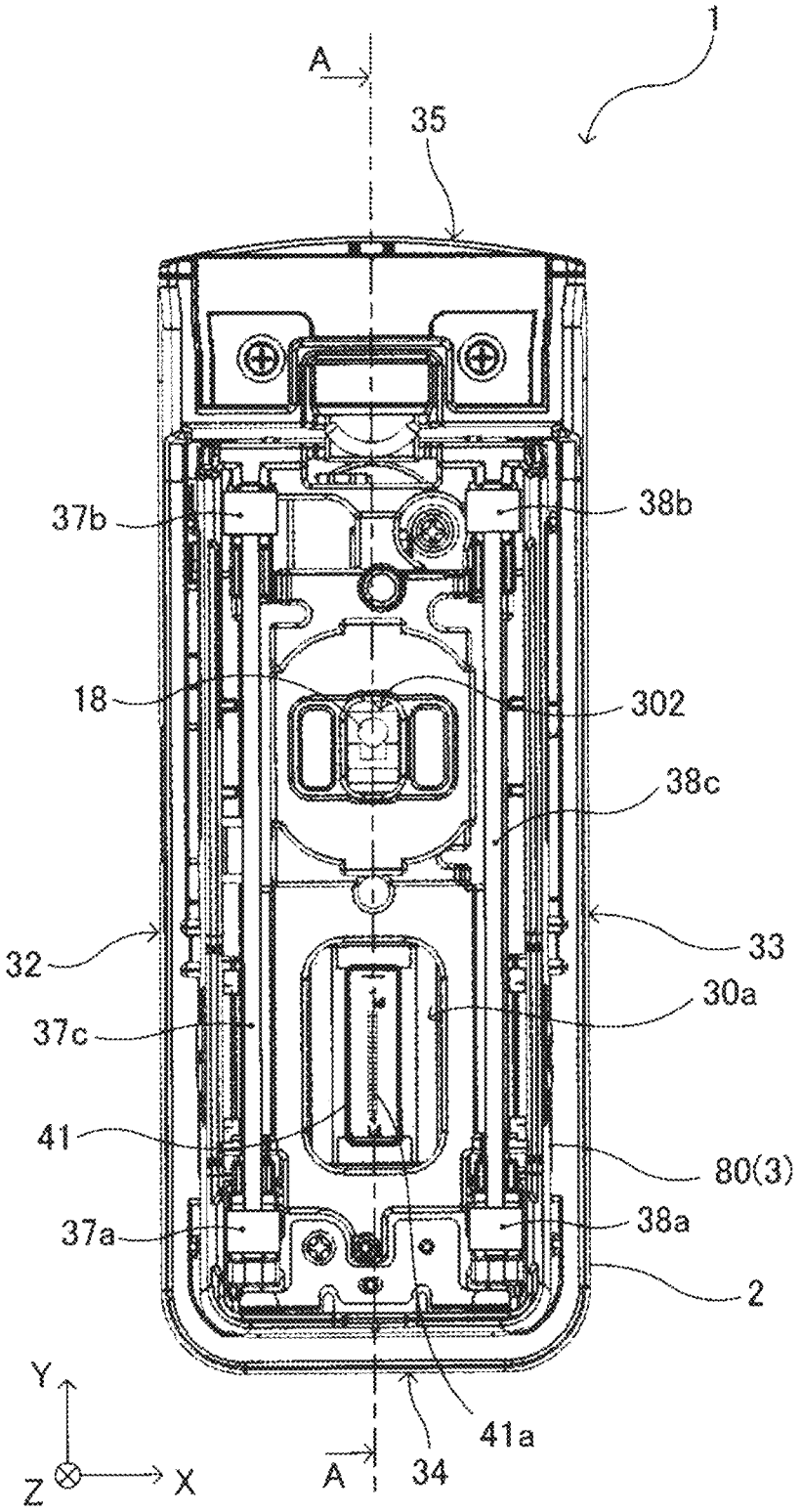
FIG. 4 is a bottom view of the handheld printer.

FIG. 2 is an exterior perspective view of the handheld printer 1 as viewed from above the rear left side. FIG. 3 is an exterior perspective view of the handheld printer 1 as viewed from below the rear right side. FIG. 4 is a bottom view of the handheld printer 1.

As illustrated in FIGS. 2 and 3, the handheld printer 1 includes an upper unit 2 and a lower unit 3. The handheld printer 1 as a whole is shaped like a rectangular parallelepiped. The handheld printer 1 has such a length in a scanning direction (that is, a printing direction or an X direction in drawings) that a user can grasp the handheld printer 1 with a palm.

As illustrated in FIGS. 2 and 4, the lateral direction (a short-side direction) of the body of the handheld printer 1 is defined as the X direction, and a longitudinal direction of the body orthogonal to the lateral direction is defined as a Y direction. In printing operation using the handheld printer 1, to linearly print letters or illustrations, the handheld printer 1 is moved in the X direction, which is the scanning direction. Then, the handheld printer 1 is moved in the Y direction to perform line feed.

However, the printing operation using the handheld printer 1 is not limited to the above-described operation. For a case where letters, illustrations, etc. are arranged attractively, the handheld printer 1 can be moved for printing in an oblique direction other than the X direction or along a curved track. In addition, the handheld printer 1 can be moved in a direction other than the Y direction for line feed.

Figure 5:
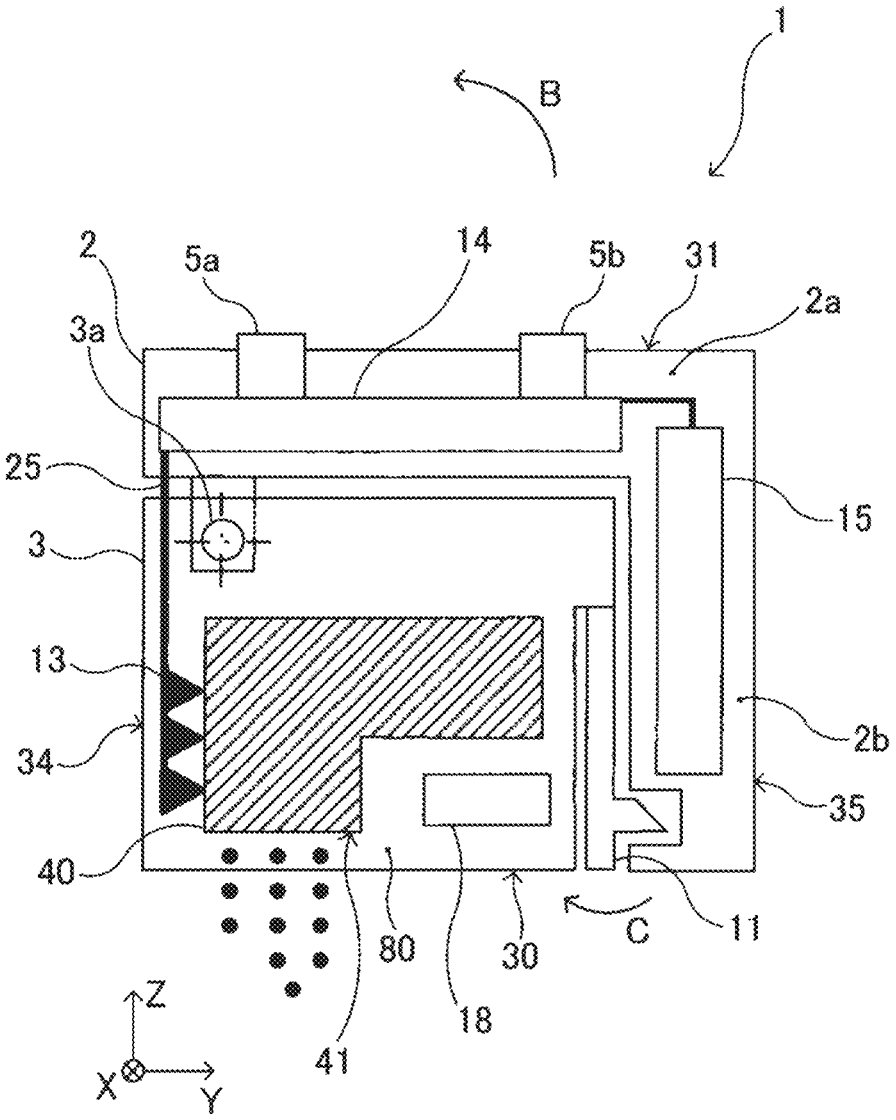
FIG. 5 is a schematic cross-sectional view of the handheld printer as viewed from the left side.

FIG. 5 is a schematic cross-sectional view of the handheld printer 1 as viewed from the left side.

As illustrated in FIG. 5, the upper unit 2 is shaped like a letter "L" and includes a horizontal portion 2*a* extending in the Y axis direction and a vertical portion 2*b* extending in the Z direction in the drawings. The vertical portion 2*b* of the upper unit 2 contains a battery 15 as a power source to supply power to components of the handheld printer 1. The horizontal portion 2*a* includes a control board 14, and a print button 5*a* and a power button 5*b* are connected to the control board 14. The power button 5*b* is a button for powering on and off the handheld printer 1, and the print button 5*a* is a button for the timing of ink discharge.

The lower unit 3 includes an upper unit rotation shaft 3*a* to rotatably support the upper unit 2, a position detection sensor 18, a flexible printed circuit (FPC) contact 13, an upper unit lock claw 11, and a housing 80 that supports these components. The position detection sensor 18 is a photosensor (reflection type) and detects position coordinates and the presence and absence of a print target. Further, the housing 80 of the lower unit 3 contains an ink cartridge 40 (an inkjet head) that includes a print head 41 (a recording device or an image forming device) and an ink tank combined into a single unit, and the ink cartridge 40 is attachable to and removable from the housing 80. The ink cartridge 40 is configured to discharge ink from the print head 41 for image formation. When the ink cartridge 40 is mounted in the handheld printer 1, the print head 41 is faced down in the vertical direction to discharge ink droplets.

As the upper unit 2 is rotated relative to the lower unit 3 in the direction indicated by arrow B in FIG. 5, an opening above the housing 80 of the lower unit 3 is exposed. Then, the ink cartridge 40 disposed therein becomes removable from the housing 80.

In the handheld printer 1 according to the present embodiment, the battery 15 is disposed in the vertical portion 2*b* of the upper unit 2, and the vertical portion 2*b* is positioned to cover a front side (on the right in FIG. 5) of the lower unit 3. Thus, the battery 15 is located on the side of a front face 35 of the ink cartridge 40. Therefore, the height of the handheld printer 1 is reduced compared with the configuration in which the battery 15, which is relatively heavy, is positioned above the ink cartridge 40. Such placement lowers the gravitational center (gravity center position) of the handheld printer 1, thus preventing the handheld printer 1 from falling over while being moved.

In the scanning direction (X direction), the size (apparatus width) of the handheld printer 1 is slightly wider than the size of the ink cartridge 40. Minimizing the apparatus width can widen the range in which the handheld printer 1 can be moved in the scanning direction on the surface of a recording sheet P and maximize a recordable range on the surface of the recording sheet P.

The handheld printer 1 includes a recording face 30 (bottom side) on which the print head 41 of the ink cartridge 40 is disposed and opposed to a recording medium, such as a paper sheet. The handheld printer 1 further has an upper face 31 on the opposite side of the recording face 30, a left face 32 extending in a direction orthogonal to the scanning direction (Y direction in the drawing) of the handheld printer 1, and the like. The handheld printer 1 further has, for example, a right face 33 extending in the direction orthogonal (Y direction) to the scanning direction (X direction), a rear face 34 extending in the scanning direction, and a front face 35 extending in the scanning direction. The handheld printer 1 is usually used in such a posture that the recording face 30 is faced vertically down and the upper face 31, which is opposite the recording face 30, is faced vertical up.

As illustrated in FIG. 2, the print button 5*a* and the power button 5*b* are disposed within an outer edge (within a frame) of the upper face 31. The left face 32 of the upper unit 2 includes a universal serial bus (USB) connection port 9. The USB connection port 9 is a port for connecting a USB cable. The handheld printer 1 is provided with the rechargeable battery 15 mounted therein. The battery 15 can be charged with electric power supplied thereto from an external power supply via the USB cable connected to the USB connection port 9.

As illustrated in FIGS. 2, 3, and 5, the L-shaped upper unit 2 is disposed to cover the upper face 31 and the front face 35 of the lower unit 3, and the upper unit 2 is wider (longer in the X direction) than the lower unit 3.

As illustrated in FIGS. 3 and 4, the face of the lower unit 3 (a bottom side of the housing 80) serving as the recording face 30 includes a discharge opening 30*a*. From the discharge opening 30*a*, the print head 41 of the ink cartridge 40 mounted in the lower unit 3 is exposed to the outside. The print head 41 of the ink cartridge 40 includes a print area 41*a* in which a plurality of discharge nozzles is disposed and is capable of discharging ink droplets separately from the respective discharge nozzles of the print area 41*a* as piezoelectric elements are driven.

The width of a print area 41*a* of the print head 41, that is, the length of the image in the direction (Y direction) orthogonal to the scanning direction, corresponds to the distance between the discharge nozzles located at both ends of the print area 41*a* in the Y direction.

The ink discharged from the discharge nozzles of the print area 41*a* of the print head 41 passes through the discharge opening 30*a* and reaches a recording sheet P, thus forming an image thereon.

Figure 6:
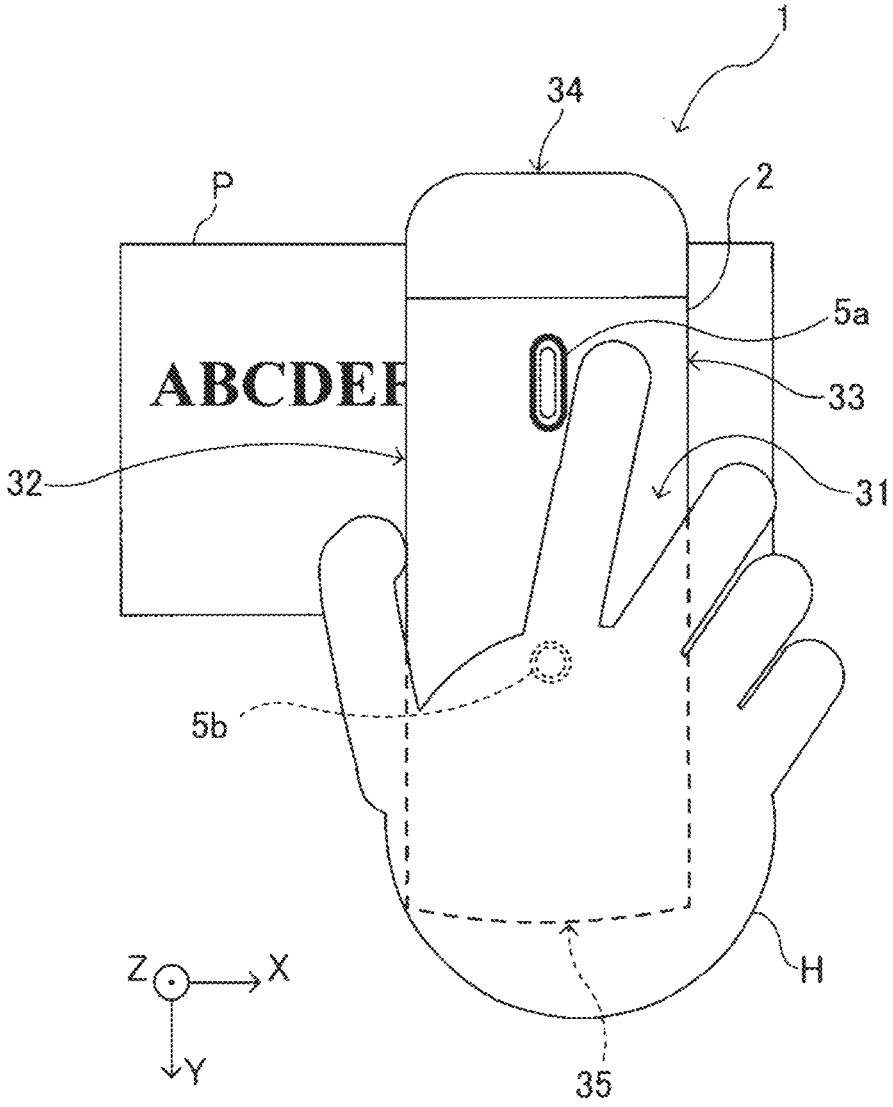
FIG. 6 is an illustration indicating a positional relationship between a hand of a user and the handheld printer being operated by the user.

FIG. 6 is an illustration indicating a positional relationship between a hand H of a user and the handheld printer 1 being operated by the user.

As illustrated in FIG. 6, to move the handheld printer 1 for image formation on the surface of the recording sheet P in the scanning direction (X direction, lateral in FIG. 6), the user holds the upper unit 2. Since the upper unit 2 is wider than the lower unit 3, the user can easily hold the upper unit 2 with the hand, and the vertical portion 2*b* thereof can serve as a container for the battery 15. Further, as illustrated in FIGS. 2 and 3, the left face 32 and the right face 33 of the lower unit 3 respectively include grip portions 39 that are recesses. The grip portions 39 are disposed, respectively, at positions where fingers (usually a thumb and a middle finger or a ring finger) of the hand H holding the upper unit 2 when the user uses the handheld printer 1. The user can put his or her fingers in the respective grip portions 39 on the left face 32 and the right face 33 with the handheld printer 1 sandwiched between these fingers, thereby holding the handheld printer 1 stably.

The user can hold the power button 5*b* for a while to switch on and off the power of the handheld printer 1. With the power turned on, the control board 14 mounted in the upper unit 2 of the handheld printer 1 can acquire image information via wireless communication using Bluetooth (registered trademark) communication or the like with an external device, e.g., a smartphone.

Figure 7:
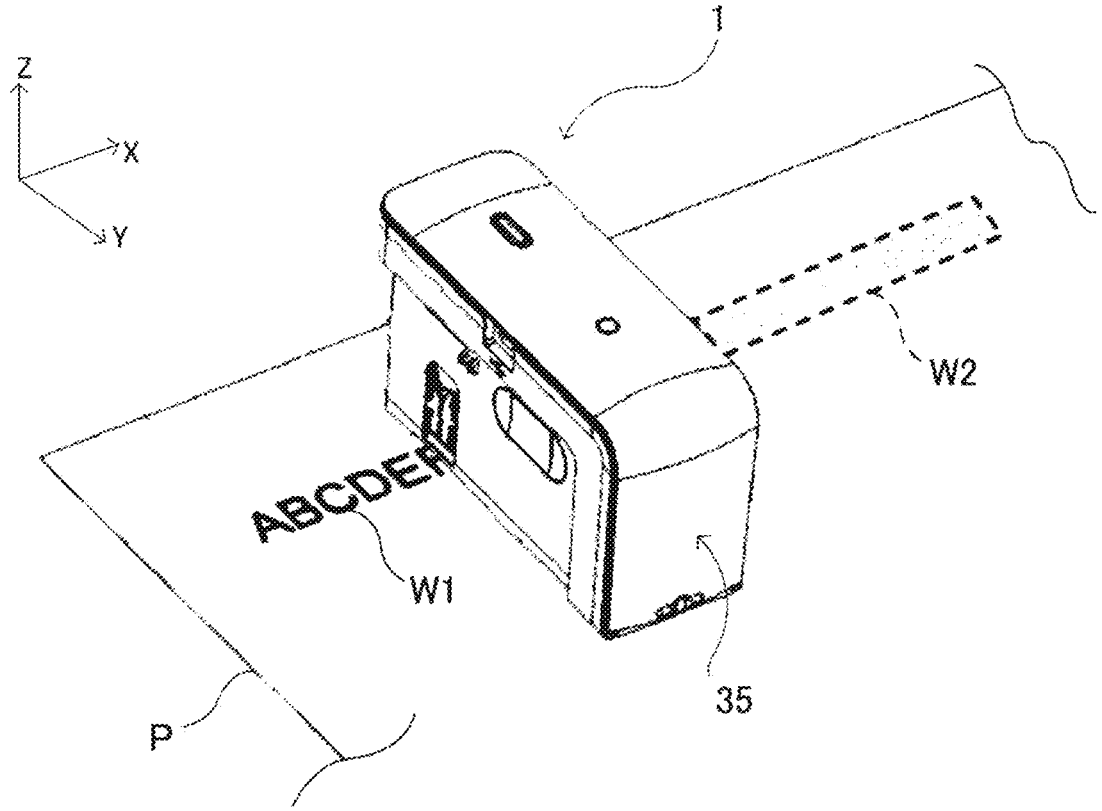
FIG. 7 is a schematic view illustrating how the handheld printer forms an image on a recording medium.

FIG. 7 is a perspective view illustrating how the handheld printer 1 forms an image on the recording sheet P.

After the image data is acquired, the user places the handheld printer 1 on the recording sheet P with the recording face 30 opposed to the surface of the recording sheet P. Then, the user presses the print button 5*a* once and moves the handheld printer 1 in the scanning direction (X axis direction) as illustrated in FIG. 7, thus forming an image on the recording sheet P. As illustrated in FIG. 7, in the image formation by the handheld printer 1, the user can check an already printed portion W1 and a planned print area W2 in which printing is to be made while moving the handheld printer 1.

Figure 8:
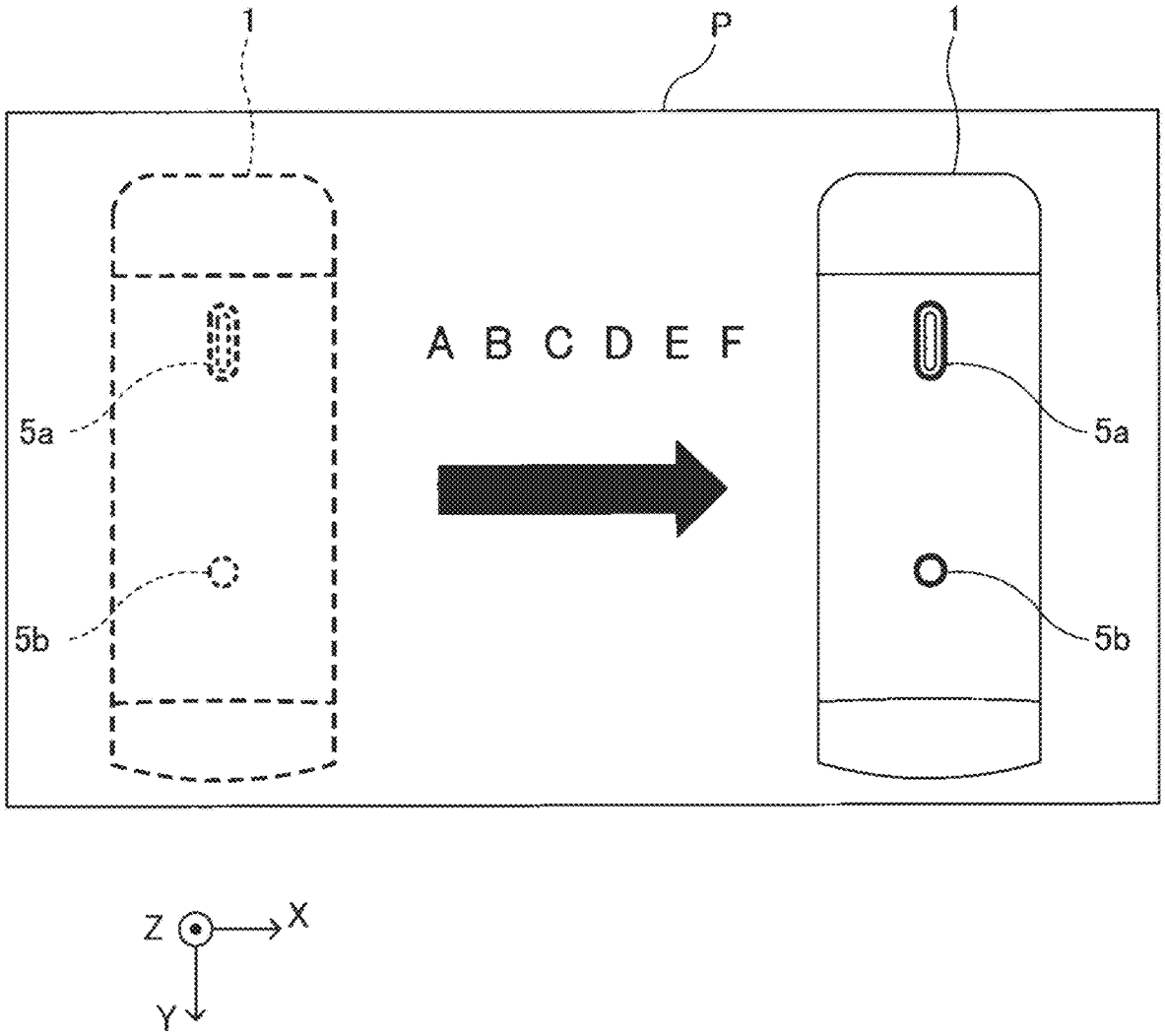
FIG. 8 is a schematic top view illustrating a positional relationship between a printed image and the handheld printer on a recording medium.

FIG. 8 is a schematic top view illustrating a positional relationship between a printed image and the handheld printer 1 on the recording sheet P.

The broken lines in FIG. 8 indicates a position of the handheld printer 1 before the handheld printer 1 is moved in the scanning direction, and the solid lines in FIG. 8 indicates a position of the handheld printer 1 after the handheld printer 1 is moved in the scanning direction.

When the user presses the print button 5*a* once and moves the handheld printer 1 in the scanning direction, the body of the handheld printer 1 is moved in the scanning direction, and the ink is ejected from each of the plurality of discharge nozzles of the print area 41*a* to print on the recording sheet P. When the handheld printer 1 is moved from a position indicated by the broken lines in FIG. 8 to another position indicated by the solid lines in FIG. 8, images are formed in the order of "A", "B", "C", "D", "E", and "F", as illustrated in FIG. 8.

In the present embodiment, the image forming position in the scanning direction (X direction) starts at a position where the exterior of the right face 33 of the handheld printer 1 is located. When the user places the handheld printer 1 to start the moving operation (manual scanning) of the handheld printer 1, an image is formed from this position on the recording sheet P.

On the other hand, the image forming position in the sub-scanning direction (Y direction) is set within a region where the discharge nozzles of the print area 41*a* of the handheld printer 1 faces the recording sheet P, when the user places the handheld printer 1 to start the moving operation (manual scanning) of the handheld printer 1. The print area 41*a* is provided on the recording face 30. In a state where the handheld printer 1 is placed on the recording sheet P, the user cannot visually recognize the printing area 41*a* and confirm the position of the print area 41*a*, therefore it is not possible to grasp the image formation position in the sub-scanning direction (Y direction).

Therefore, in the handheld printer 1 of this embodiment, the sub-scanning guides 7 are provided, and the user can grasp the position of the image to be formed in the sub-scanning direction by looking at the sub-scanning guides 7 when the user manually moves the handheld printer 1 in the scanning direction (X direction).

The handheld printer 1 can form an image on the surface of the recording sheet P both when the user moves the handheld printer 1 (manual scanning) toward one side (right side in FIG. 7) in the scanning direction (X direction and when the user moves the handheld printer 1 to the opposite side (left side in FIG. 7) in the scanning direction. The handheld printer 1 can be configured to discharge ink from the ink cartridge 40 continuously after the user once presses and releases the print button 5*a* or discharge ink from the ink cartridge 40 only while the user presses the print button 5*a*.

The recording medium is not limited to paper, such as recording sheet P, but includes, for example, overhead projector (OHP) sheets, cloth, cardboards, packaging containers, glass, and substrates.

As a driving source to discharge ink, the ink cartridge 40 can employ, for example, an electromechanical transducer element (a piezoelectric actuator) including a lamination-type piezoelectric element or a thin-film-type piezoelectric element. Example configurations of the driving source further include an electrothermal transducer element, such as a heat element, and an electrostatic actuator including a diaphragm and opposed electrodes.

The ink cartridge 40 has a so-called inkjet mechanism to discharge liquid or droplets such as ink to perform recording. Any inkjet mechanism mountable in the handheld printer 1 can be used. In the handheld printer 1 according to the present embodiment, the inkjet mechanism corresponds to the print head 41 that records an image on the recording sheet P, and the print head 41 is stored in the housing 80 of the lower unit 3.

The ink "liquid" discharged from the discharge nozzles of the print area 41*a* of the print head 41 is not particularly limited as long as the liquid has a viscosity and a surface tension that can be discharged from the discharge nozzles. However, it is preferable that the viscosity is 30 mPa-s or less under ordinary temperature and pressure or by heating or cooling. Specifically, the term "ink (liquid)" represents, for example, a solution, a suspension, or an emulsion including a solvent, such as water or organic solvent, a colorant, such as a dye or a pigment, a polymerizable compound, a resin, a functional material, such as a surfactant, a biocompatible material, such as deoxyribonucleic acid (DNA), amino acid, protein, or calcium, or an edible material, such as a natural colorant. Such a solution, a suspension, or an emulsion can be used for, e.g., inkjet ink, a surface treatment liquid, liquid for forming components of electronic elements or light-emitting elements, liquid for forming resist patterns of electronic circuits or a material solution for three-dimensional fabrication.

As illustrated in FIG. 4, inside the outer edge of the recording face 30, the position detection sensor 18 as a detector is disposed. The position detection sensor 18 detects the position of the handheld printer 1 on the recording sheet P in a non-contact manner. The lower face of the housing 80 serving as the recording face 30 is provided with a detection opening 302 to expose a detection portion of the position detection sensor 18.

In the case of a contact type sensor using a rotary encoder or the like, the sensor needs to be in contact with the print surface, and a detection error due to the contact state is likely to occur. Specifically, when the detection portion of the contact type sensor separates from or slips on the print surface, the actual moving direction and travel distance differ from the moving direction and travel distance calculated based on the detection result, which becomes a detection error. By contrast, the accuracy of detection of the moving direction and the travel distance is higher when an optical sensor as the position detection sensor 18 detects the print surface in a non-contact manner.

Further, as illustrated in FIG. 4, inside the outer edge of the recording face 30, a first left roller 37*a*, a second left roller 37*b*, a first right roller 38*a*, and a second right roller 38*b* are disposed and rotatably attached to the housing 80. The first left roller 37*a* and the second left roller 37*b* are secured to a left rotation shaft 37*c*, and the left rotation shaft 37*c* is rotatably held by the housing 80. Similarly, the first right roller 38*a* and the second right roller 38*b* are secured to a right rotation shaft 38*c*, and the right rotation shaft 38*c* is rotatably held by the housing 80.

When the handheld printer 1 is moved in the scanning direction by the user, the four rollers (37*a*, 37*b*, 38*a*, and 38*b*) in contact with the surface of the recording sheet P rotate like tires. Owing to such rollers, the user can advance the handheld printer 1 straight in the scanning direction. When the handheld printer 1 is moved straight in the scanning direction, only the four rollers (37*a*, 37*b*, 38*a*, and 38*b*) provided on the handheld printer 1 are in contact with the surface of the recording sheet P or the surface of the table on which the recording sheet P is placed. The recording face 30 is not in contact with the surface of the recording sheet P. Therefore, the user can move the handheld printer 1 straight along the scanning direction while keeping a constant distance between the print head 41 of the ink cartridge 40 and the surface of the recording sheet P. Thus, a desired high-quality image can be formed. That is, the four rollers guide the movement of the handheld printer 1 in the scanning direction and assist the linear movement in the scanning direction.

The position detection sensor 18 is a sensor to detect the distance to the surface of the recording sheet P, the surface state (for example, asperities) of the recording sheet P, and the distance by which the handheld printer 1 has traveled. A similar sensor, for example, an optical mouse (a pointing device) of a personal computer can be used for the position detection sensor 18. The position detection sensor 18 irradiates, with light, a place (e.g., the recording sheet P) where the position detection sensor 18 is placed and reads the state of the place as a "pattern". The position detection sensor 18 sequentially detects how the "pattern" moves relative to the movement of the position detection sensor 18, to calculate the amount of movement. As the position detection sensor 18, any sensor other than an optical sensor such as an ultrasonic sensor can be used as long as a change in position with respect to the recording sheet P can be detected in a contactless manner. The position detection device of mobile image forming apparatuses, such as the handheld printer 1, to which aspects of the present disclosure can be applied is not limited to a contactless sensor such as the position detection sensor 18, but can be a contact sensor using a rotary encoder or the like.

Figure 9:
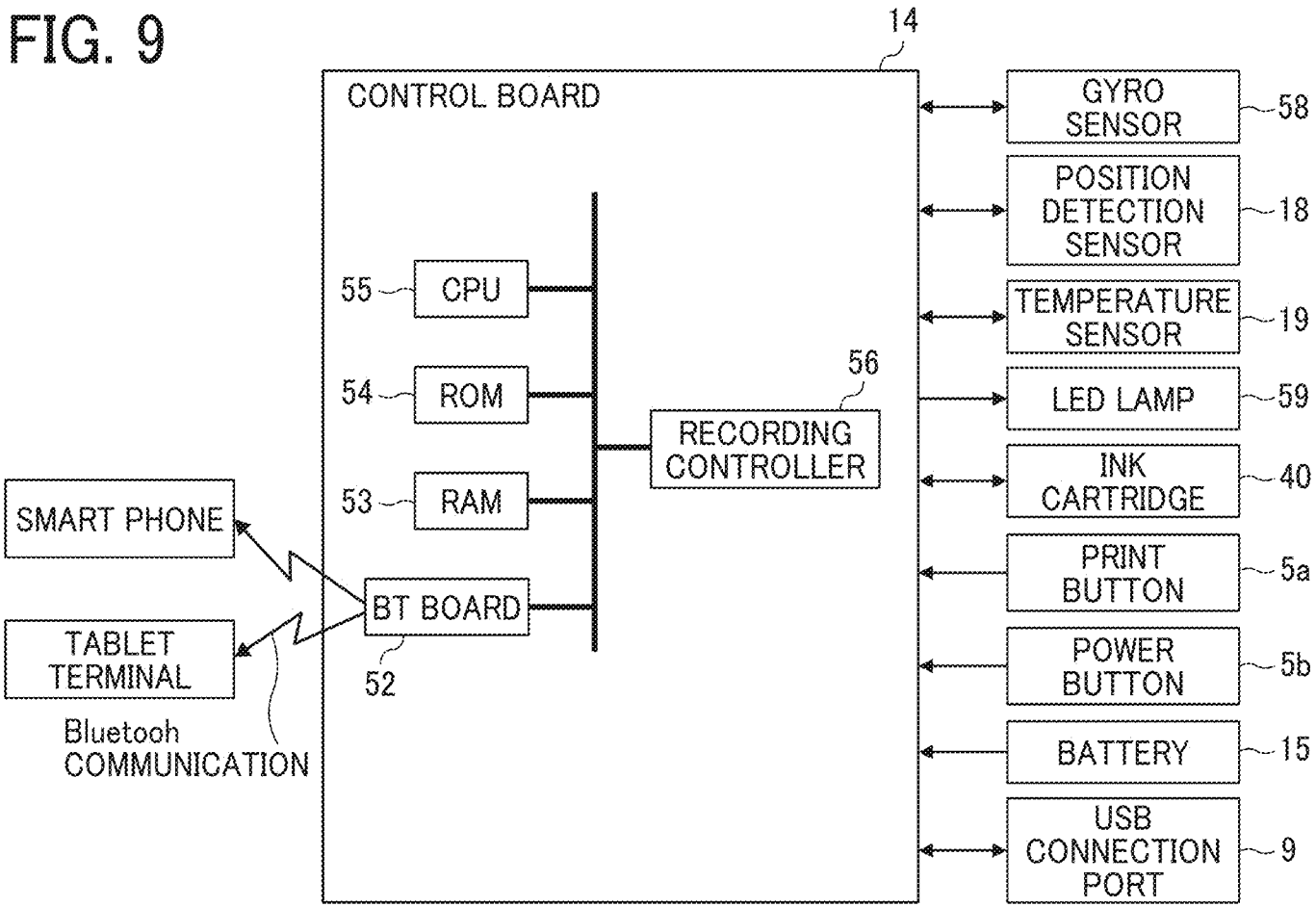
FIG. 9 is a block diagram illustrating a part of an electric circuit of the handheld printer.

FIG. 9 is a block diagram illustrating a portion of an electric circuit of the handheld printer 1.

The control board 14 includes a central processing unit (CPU) 55 that performs various arithmetic processing and program execution, a Bluetooth (registered trademark, hereinafter "BT") board 52 for short-range wireless communication using Bluetooth, a random access memory (RAM) 53 that temporarily stores data, a read-only memory (ROM) 54, and a recording controller 56. The control board 14 is secured at a position on the inner side of the USB connection port 9 in a hollow space of the upper unit 2.

The BT board 52 performs data communication by short-range wireless communication with an external device, such as a smartphone or a tablet terminal. The ROM 54 stores, for example, firmware for hardware control of the handheld printer 1 and drive waveform data of the ink cartridge 40. The recording controller 56 executes data processing for driving the ink cartridge 40 and generates drive waveforms.

The control board 14 is electrically connected to a gyro sensor 58, the position detection sensor 18, a temperature sensor 19, a light emitting diode (LED) lamp 59, the ink cartridge 40, the print button 5*a*, the power button 5*b*, the battery 15, and the like. The gyro sensor 58 detects a tilt and a rotation angle of the handheld printer 1 and transmits the result of detection to the control board 14. The LED lamp 59 is disposed inside an exterior cover made of a light transmissive material of the print button 5*a* and makes the print button 5*a* luminous.

When the power button 5*b* is pressed to turn on the power of the handheld printer 1, power is supplied to each module. The CPU 55 initiates startup according to the program stored in the ROM 54 and loads the program and each data in the RAM 53. When data of an image to be formed is received from an external device by short-range wireless communication, the recording controller 56 generates a drive waveform corresponding to the image data. The discharge of ink from the ink cartridge 40 is controlled to form an image corresponding to the position on the surface of the recording sheet P detected by the position detection sensor 18.

The position detection sensor 18 detects the direction and the speed of movement of the handheld printer 1 and the distance by which the handheld printer 1 has traveled. The discharge amount of ink and the discharge position of ink are adjusted based on the detection result of the position detection sensor 18, thereby printing a target image. Further, the discharge start position can be adjusted using sub-scanning guides 7 provided on the left face 32 and the right face 33 of the housing 80 and a main scanning guide 10 provided on the rear face 34 of the housing 80. Specifically, the main scanning guide 10 is used to align the position of the handheld printer 1 on the recording sheet P in the main scanning direction (X direction in the figure), and the sub-scanning guides 7 are used to align the position of the handheld printer 1 on the recording sheet P in the sub-scanning direction (Y direction). Thus, the discharge start position can be adjusted.

In response to acquisition of image data via short-range wireless communication from an external device, the control board 14 causes the LED lamp 59 to blink so that the light transmissive print button 5*a*, which transmits light, becomes luminous and blinks. Seeing such light blinking, the user knows the completion of the acquisition of the image data. Then, the user places the handheld printer 1 on the recording sheet P and presses the print button 5*a*.

Meanwhile, as the control board 14 starts blinking of the LED lamp 59, the control board 14 waits for pressing of the print button 5*a*. When the print button 5*a* is pressed, the control board 14 causes the LED lamp 59 to keep emitting light so that the print button 5*a* continuously emits light. Seeing the continuous light emission, the user starts moving the handheld printer 1 (manual scanning) in the scanning direction.

The user who has finished moving the handheld printer 1 (manual scanning) again presses the print button 5*a*. With such an operation, the control board 14 turns off the LED lamp 59 and stops lighting of the print button 5*a*. Or, there may be a case where the user does not press the print button 5*a* but picks up the handheld printer 1 from the recording sheet P and places the handheld printer 1 on, for example, a table or mounts the handheld printer 1 in a cover that covers the recording face 30. In these cases, the position detection sensor 18 becomes incapable of detecting the position when the handheld printer 1 is picked up from the recording sheet P. At the timing when the position detection sensor 18 no longer detects the position, the control board 14 turns off the LED lamp 59 and stops lighting of the print button 5*a*. Seeing the stop of the lighting, the user knows that the operation of the handheld printer 1 for printing has ended.

In the handheld printer 1 according to the present embodiment, it is not necessary to keep pushing the print button 5*a* while the user moves the handheld printer 1 (manual scanning). When the print button 5*a* is pressed and released prior to the moving of the handheld printer 1, printing operation is continued until a predetermined timing. Examples of the predetermined timing include a timing when the image formation based on the detection result by the position detection sensor 18 ends, a timing when the print button 5*a* is pressed again, and a timing when the position detection sensor 18 becomes incapable of position detection.

When the image formation is not performed, such as after the image formation is completed, a capping unit that covers the recording face 30 of the handheld printer 1 is attached to the handheld printer 1. Thereby, drying of the ink in the discharge nozzles of the print area 41*a* can be prevented.

In the handheld printer 1 according to the present embodiment, a grip portion 39 is provided on each of the left face 32 and the right face 33. It is desirable that the grip portions 39 are disposed at the gravitational center on the Y-Z plane of the handheld printer 1. Specifically, the gravitational center on the Y-Z plane of the handheld printer 1 is disposed so as to be positioned inside the grip portions 39 on the Y-Z plane. The following effect can be attained by providing the grip portions 39, in which the user puts his or her finger to grip the handheld printer 1, in the vicinity of the gravitational center of the handheld printer 1. The user can be guided to grip the vicinity of the gravitational center of the handheld printer 1, so that the user can smoothly operate the handheld printer 1.

Next, the operation to take out the ink cartridge 40 from the handheld printer 1 according to the present embodiment is described.

Figure 10:
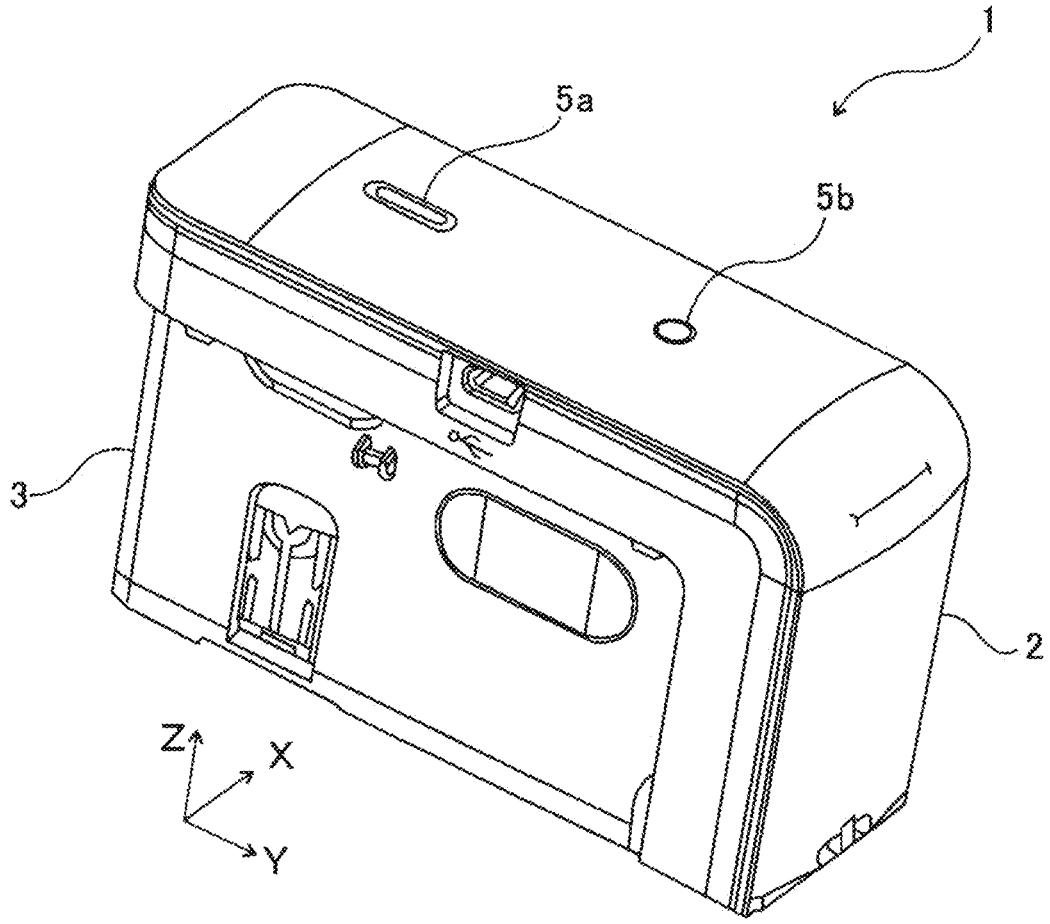
FIG. 10 is an exterior perspective view illustrating the handheld printer as viewed from above on a front left side.
Figure 11:
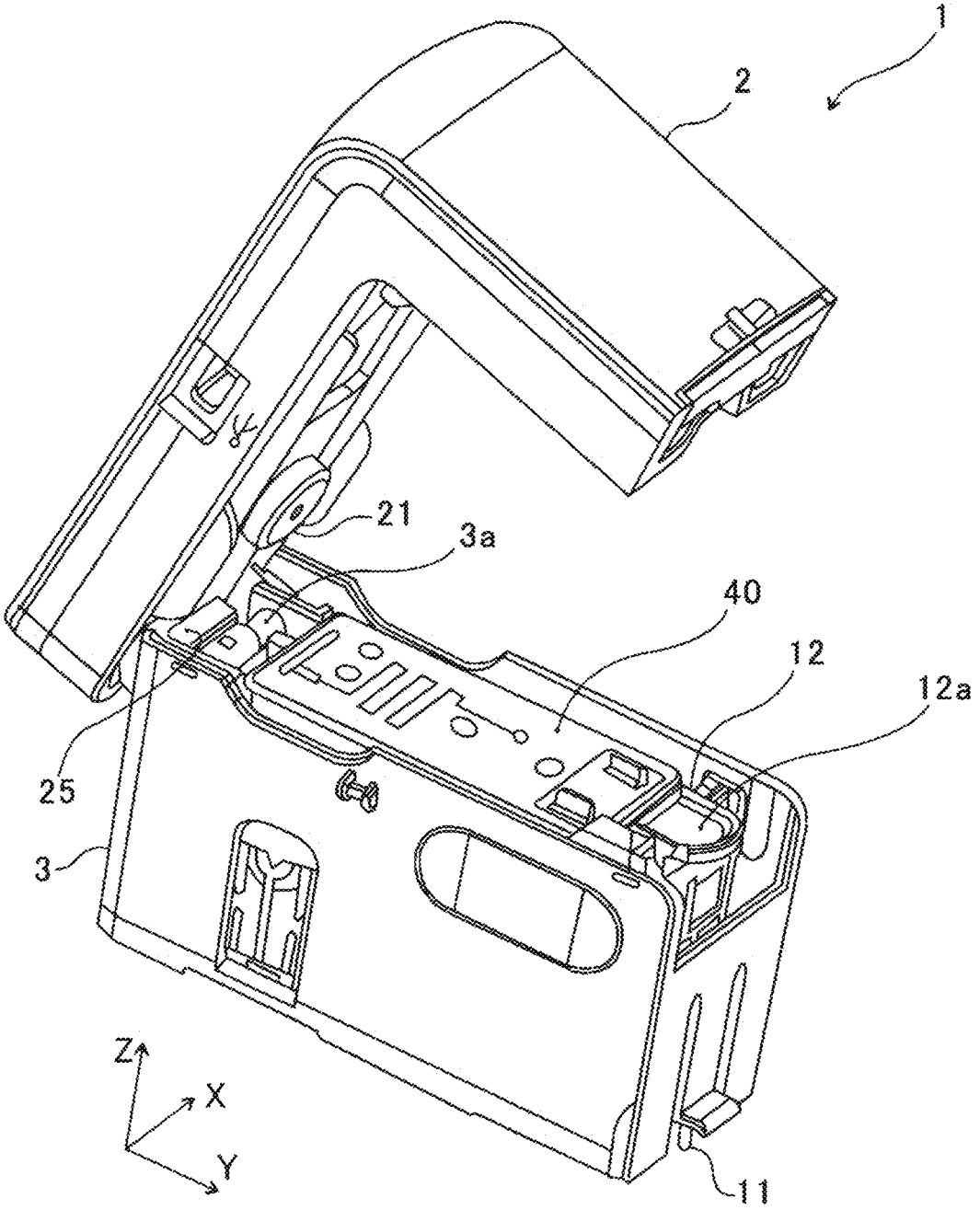
FIG. 11 is an exterior perspective view of the handheld printer with an upper unit thereof opened.

FIG. 10 is an exterior perspective view of the handheld printer 1, as viewed from the upper left on the front side. FIG. 11 is a perspective view of the handheld printer 1 in a state in which the upper unit 2 is rotated in the direction indicated by arrow B illustrated in FIG. 5, with respect to the lower unit 3, from the state illustrated in FIG. 10.

As illustrated in FIGS. 4 and 5, the upper unit lock claw 11 is disposed in the vicinity of the boundary between the lower unit 3 (the bottom side of the housing 80) and the upper unit 2 (the bottom side of the vertical portion 2*b*) on the recording face 30 of the handheld printer 1. The upper unit lock claw 11 is operated to move in the direction indicated by arrow C in FIG. 5, to release the lock of the upper unit 2 from the lower unit 3. In such a released state, the upper unit 2 is rotated relative to the lower unit 3, around the upper unit rotation shaft 3*a* in the direction indicated by arrow B in FIG. 5. Then, the upper unit 2 is open relative to the lower unit 3, as illustrated in FIG. 11.

As illustrated in FIG. 11, when the upper unit 2 is in the open state, the ink cartridge 40 and a cartridge attaching and detaching mechanism 12 are exposed. Also, as illustrated in FIG. 11, on an inner face of the upper unit 2, a cartridge upper pressing member 21 to press and hold the ink cartridge 40 mounted in the lower unit 3 is secured.

Figure 12:
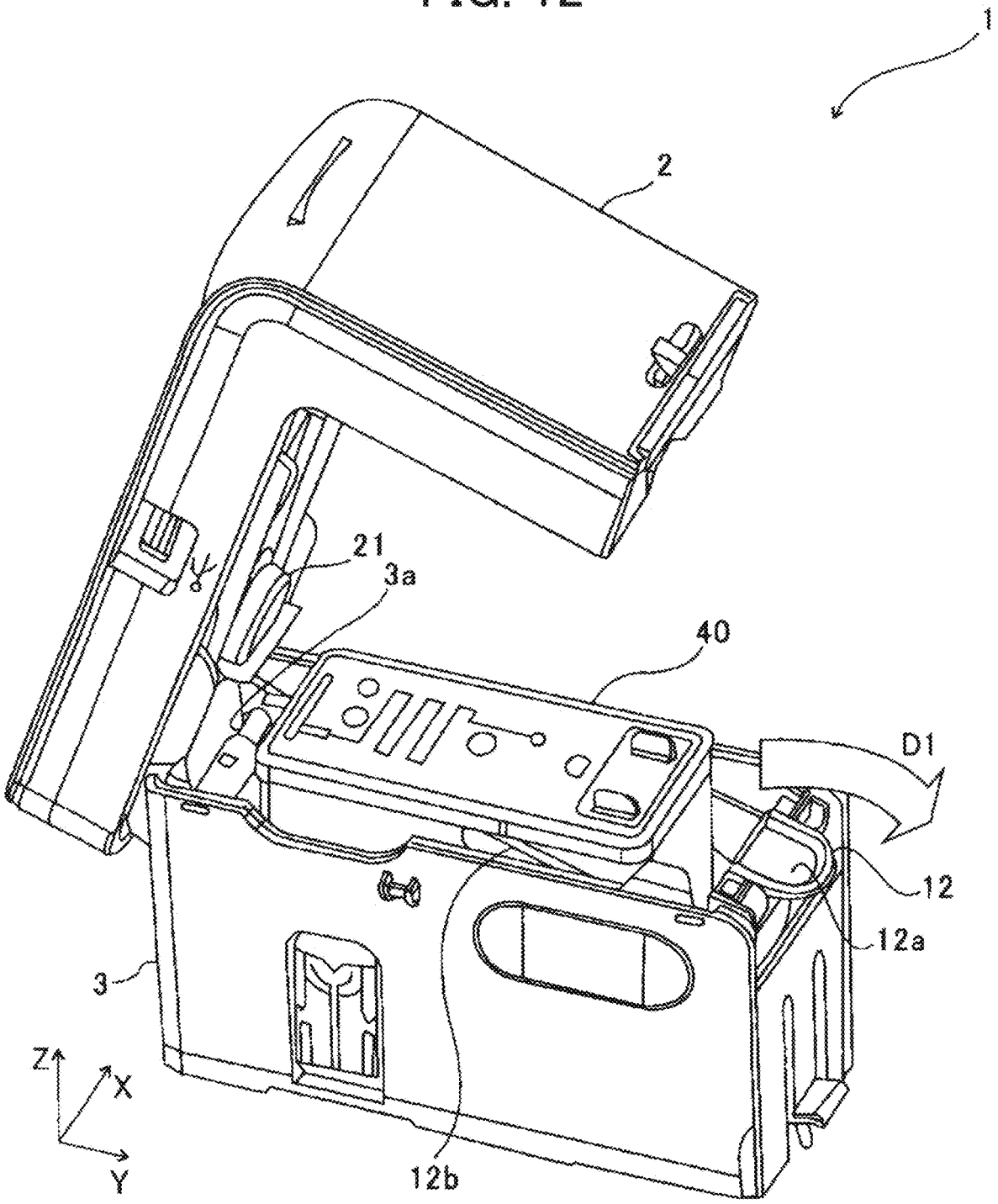
FIG. 12 is a perspective view illustrating a state of the handheld printer in which an ink cartridge pops up.

FIG. 12 is a perspective view of the handheld printer 1 in a state in which the ink cartridge 40 is pushed up by operating an operated portion 12*a* (e.g., a lever or a handle)

of the cartridge attaching and detaching mechanism 12 of the handheld printer 1 in a state illustrated in FIG. 11.

As the operated portion 12*a* of the cartridge attaching and detaching mechanism 12 is pulled to the front side as indicated by arrow D1 in FIG. 12, the ink cartridge 40 pops up from a state illustrated in FIG. 11 to the state illustrated in FIG. 12. As a result, the ink cartridge 40 becomes removable.

Figure 13:
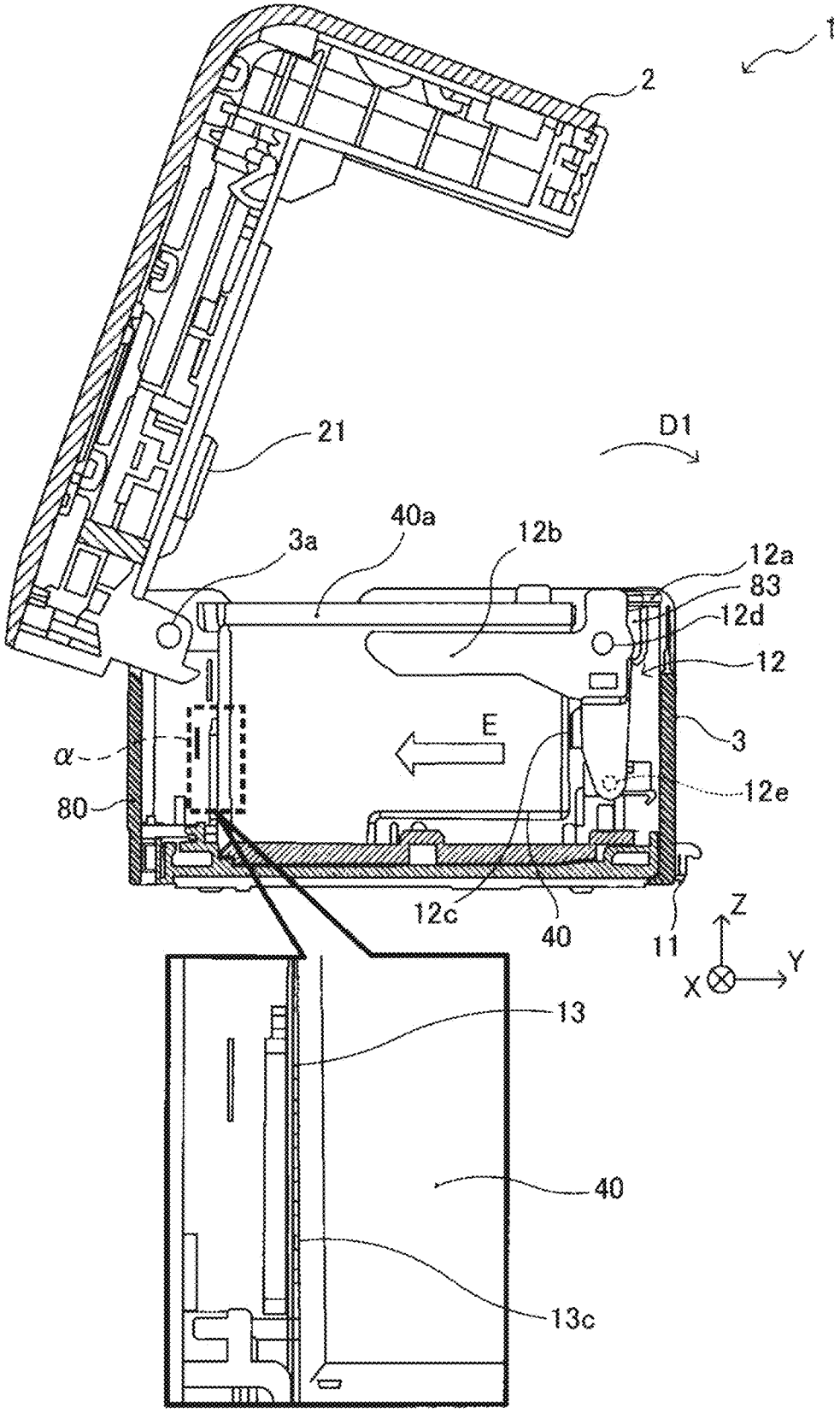
FIG. 13 is a cross-sectional view, from a side, of the handheld printer illustrated in FIG. 11.

FIG. 13 is a cross-sectional view of the handheld printer 1 illustrated in FIG. 11 as viewed from the left face 32 side. Specifically, FIG. 13 illustrates a cross section at the position of an inner side wall on the left face 32 side of the housing 80. The upper section of FIG. 13 is a cross-sectional view of the entire handheld printer 1, and the lower section of FIG. 13 is an enlarged cross-sectional view of a region "a" indicated by broken lines in the upper section of FIG. 13. A cartridge holder 6 (illustrated in FIGS. 18 and 19 but not in 13 for simplicity) is secured inside the housing 80 which holds the ink cartridge 40 (described of the cartridge holder are described later).

As illustrated in FIG. 13, a pressing portion 12*c* of the cartridge attaching and detaching mechanism 12 presses a lateral side face of the ink cartridge 40 on the front side (right side in FIG. 13), thereby pressing the ink cartridge 40 to the rear side (left side in FIG. 13) as illustrated by the arrow E in FIG. 13. Thus, the contact of the ink cartridge 40 is pressed to the FPC contact 13 which is an apparatus body-side connector fixed to the body of the handheld printer 1.

Figure 14:
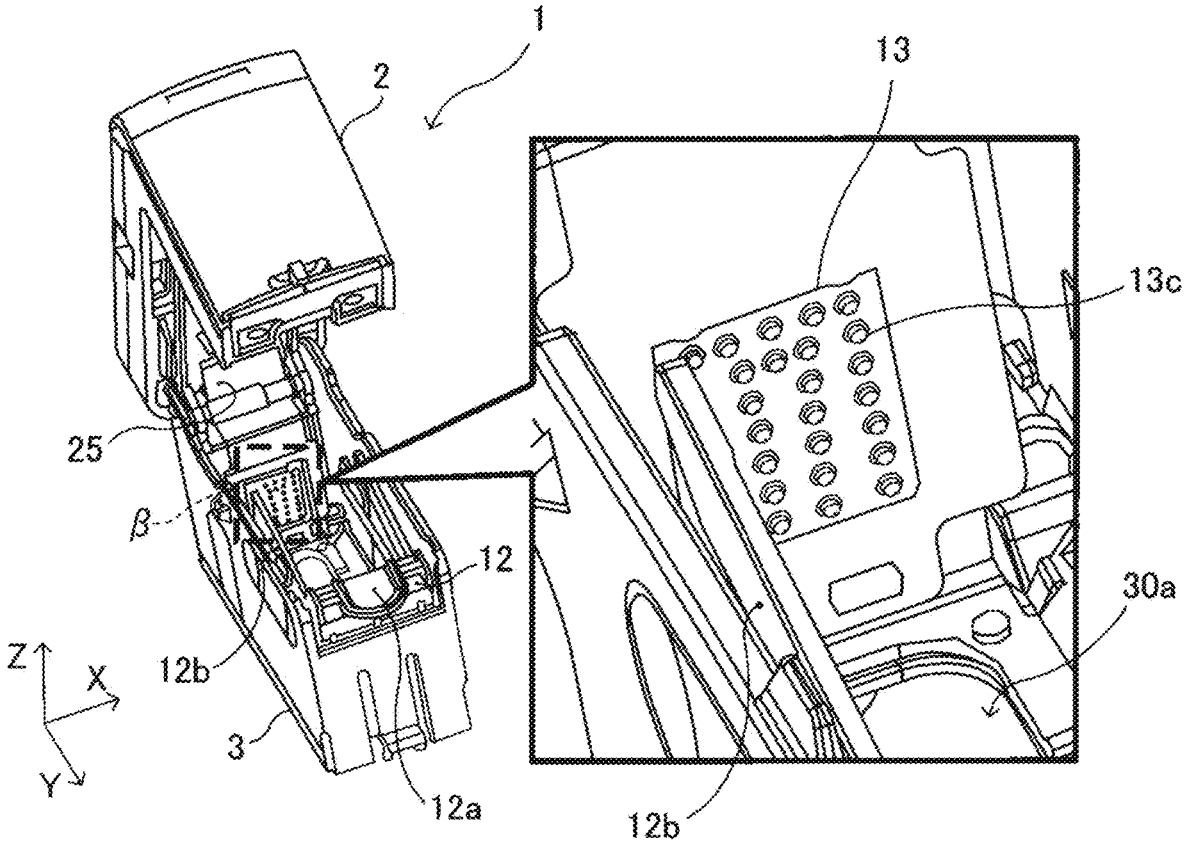
FIG. 14 is a perspective view of the handheld printer with the ink cartridge removed.

FIG. 14 is a perspective view of the handheld printer 1 in the state in which the upper unit 2 is open and the ink cartridge 40 is removed, as viewed obliquely above on the front side. The left section of FIG. 14 is a perspective view of the entire handheld printer 1, and the right section of FIG. 14 is an enlarged perspective view of a region "f3" indicated by broken lines in the left section of FIG. 14.

As illustrated in FIG. 14, the FPC contact 13 is disposed on the inner wall face on the rear side of the space where the ink cartridge 40 is disposed in the lower unit 3. The FPC contact 13 includes a plurality of body-side connection terminals 13*c* protruding into a space where the ink cartridge 40 is disposed.

Figure 15A:
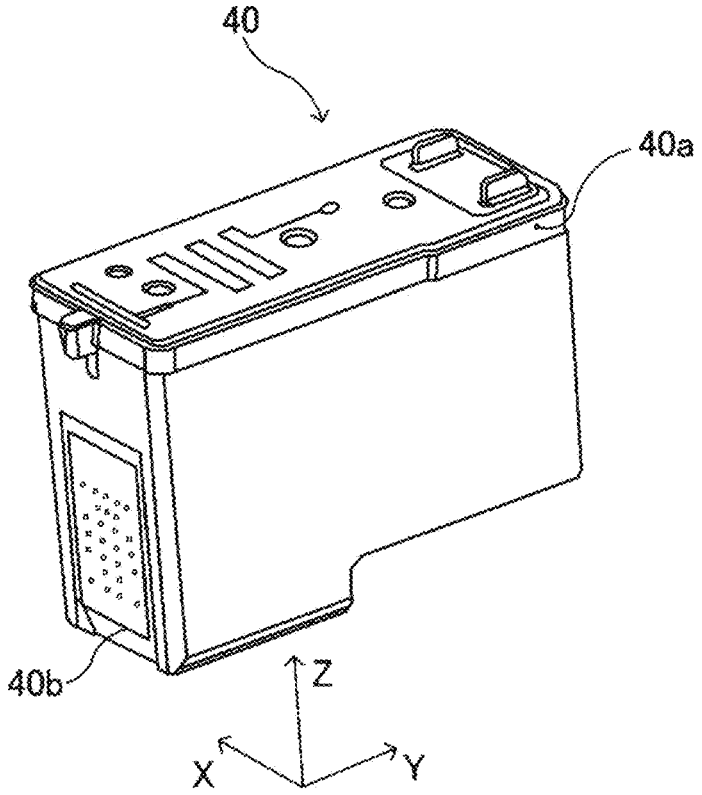
FIGS. 15A and 15B are perspective views illustrating the ink cartridge.
Figure 15B:
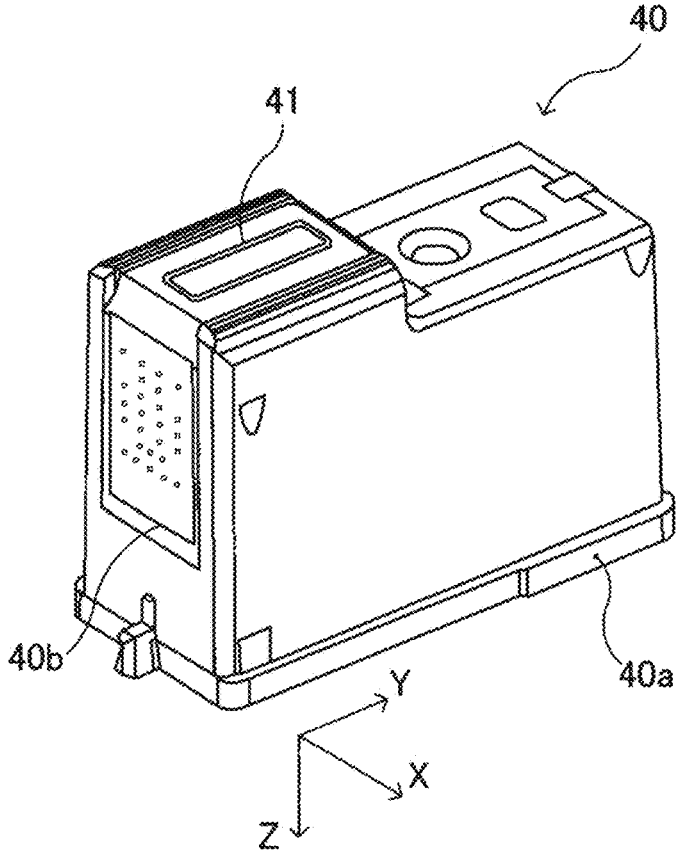

FIGS. 15A and 15B are perspective views of the ink cartridge 40. FIG. 15A is a perspective view of the ink cartridge 40 as viewed from above on the rear left side, and FIG. 15B is a perspective view of the ink cartridge 40 as viewed from below on the rear right side.

Figure 16A:
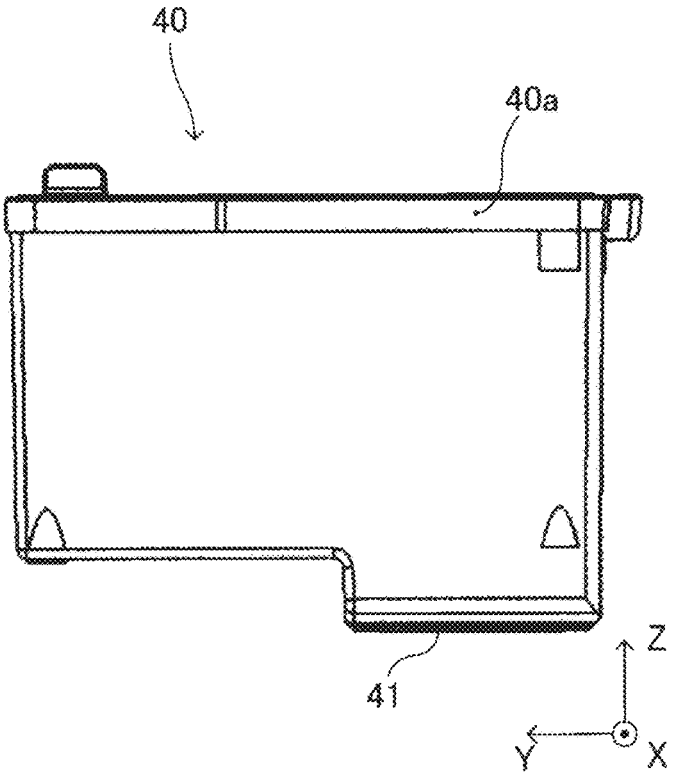
FIGS. 16A, 16B and 16C are views illustrating the ink cartridge viewed from three sides.
Figure 16B:
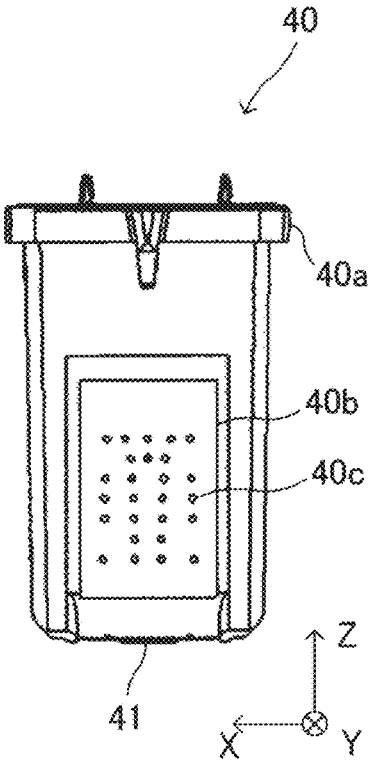
Figure 16C:
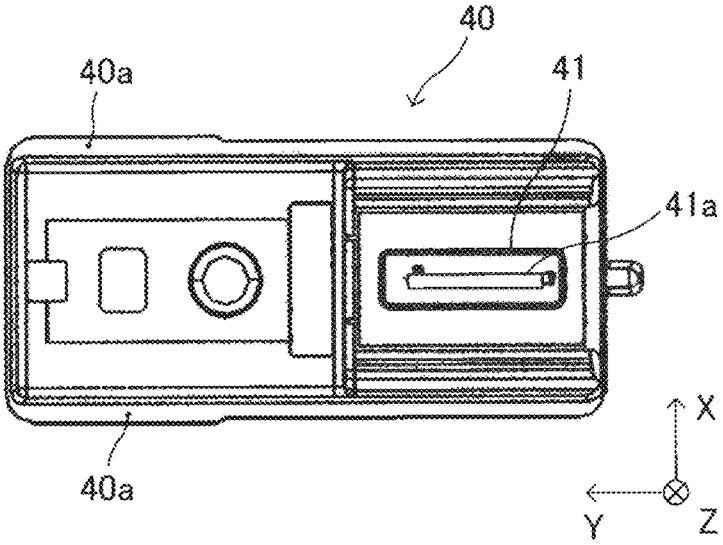

FIGS. 16A, 16B and 16C are views illustrating the ink cartridge 40 viewed from three sides. FIG. 16A is a right side view, FIG. 16B is a rear view and FIG. 16C is a bottom view.

As illustrated in FIGS. 15 and 16A, the ink cartridge 40 has a portion extending downward at the end of the portion extending in the horizontal direction, and is L-shaped when viewed from the side. In addition, a print head 41 that discharges ink is provided on the lower surface of the portion extending downward.

As illustrated in FIGS. 15A, 15B and 16B, a cartridge-side contact 40*b* is disposed on the outer wall surface on the rear side of the ink cartridge 40. The cartridge-side contact 40*b* electrically connects the handheld printer 1 body and the ink cartridge 40. The cartridge-side contact 40*b* is a flexible substrate, and the cartridge-side contact 40*b* has a plurality of cartridge-side connection terminals 40*c* that respectively comes into contact with the plurality of body-side connection terminals 13*c* of the FPC contact 13. The electrical power is supplied to the handheld printer 1 body and the ink cartridge 40 when each of the plurality of cartridge-side connection terminals 40*c* is connected to each of the plurality of body-side connection terminals 13*c* with correct positional relationship and appropriate contact pressure.

As illustrated in FIG. 15B and FIG. 16C, the print head 41 is disposed on the bottom face of the ink cartridge 40, and the print head 41 includes the print area 41*a* where a plurality of print nozzles (discharge nozzles) is disposed.

When the ink cartridge 40 is mounted on the lower unit 3 and the FPC contact 13 is electrically connected with the cartridge-side contact 40*b*, power is supplied from the power source (the battery 15) to the ink cartridge 40. Further, an electrical signal for controlling the ink cartridge 40 is transmitted to the ink cartridge 40.

As illustrated in FIGS. 5, 11, and 14, a flexible flat cable 25 is disposed on the rear face 34 side of the upper unit rotation shaft 3*a*. The flexible flat cable 25 connects the control board 14 in the upper unit 2 to the FPC contact 13 in the lower unit 3. The flexible flat cable 25 can be deformed in accordance with the opening and closing operation of the upper unit 2, and the connection between the control board 14 and the FPC contact 13 can be maintained even when the opening and closing operation of the upper unit 2 is repeated.

Figure 17:
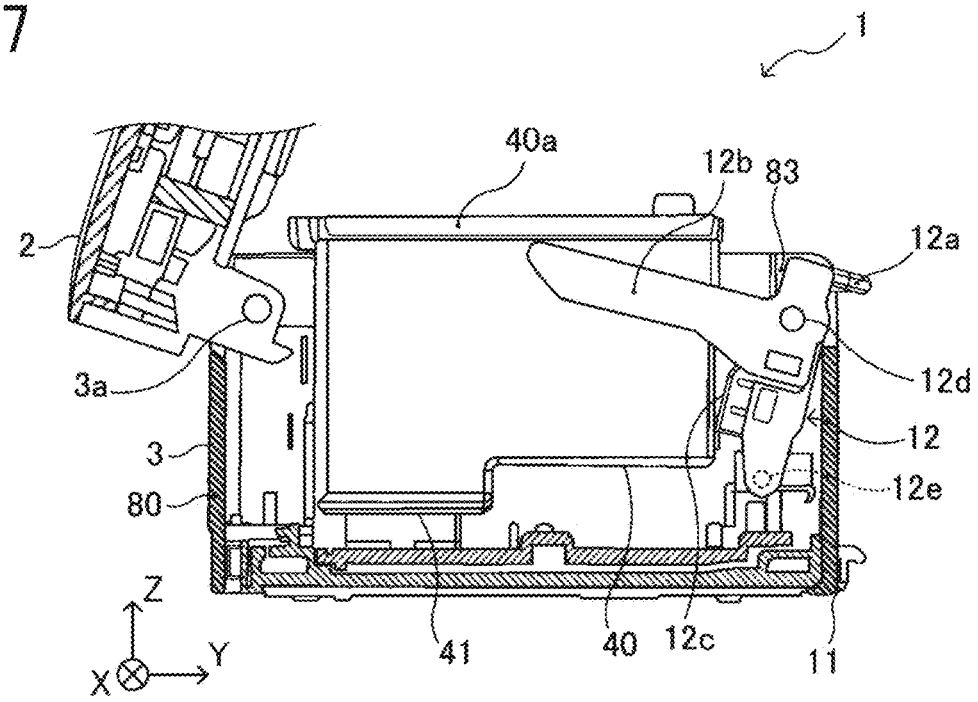
FIG. 17 is a cross-sectional view, from a side, of the handheld printer illustrated in FIG. 12.

FIG. 17 is a cross-sectional view of the handheld printer 1 as viewed from the left face 32 side in a state in which the ink cartridge 40 pops up as illustrated in FIG. 12. Specifically, similar to FIG. 13, FIG. 17 illustrates a cross section at the position of the inner side of the wall on the left face 32 side of the housing 80.

As the operated portion 12*a* of the cartridge attaching and detaching mechanism 12 is pulled to the front face 35 side as indicated by arrow D1 in FIG. 13, the cartridge attaching and detaching mechanism 12 rotates, centering on an attaching and detaching mechanism rotation shaft 12*e* of the cartridge attaching and detaching mechanism 12, to the front face 35 side. At this time, the cartridge attaching and detaching mechanism 12 rotates to a position where a projecting stopper 12*d* provided in the cartridge attaching and detaching mechanism 12 fits in a stopper groove 83 provided in the housing 80. By this rotation, a push-up lever 12*b* of the cartridge attaching and detaching mechanism 12 pushes up a flange portion 40*a* of the ink cartridge 40 from the state illustrated in FIG. 13. Then, the ink cartridge 40 pops up from the state illustrated in FIG. 13 to the state illustrated in FIG. 17. As a result, the ink cartridge 40 becomes removable by manual operation of the user.

To mount the ink cartridge 40 in the body of the handheld printer 1 according to the present embodiment, the ink cartridge 40 is set in the hollow portion inside the lower unit 3 in the state in which the upper unit 2 is open as illustrated in FIG. 14. At this time, the user presses the upper face of the ink cartridge 40 to insert the ink cartridge 40 to the position illustrated in FIG. 13 and close the upper unit 2. As a result, image formation can be performed using the mounted ink cartridge 40.

Further, in the handheld printer 1 according to the present embodiment, the upper unit 2 can be closed in the state illustrated in FIG. 17 before the ink cartridge 40 is inserted to the position illustrated in FIG. 13. In this case, the cartridge upper pressing member 21 of the upper unit 2 presses the upper face of the ink cartridge 40 positioned at the same position as in the pop-up state, and the ink cartridge 40 can be set at the position illustrated in FIG. 13.

In the handheld printer 1 according to the present embodiment, only the upper unit 2 is the cover that is opened to mount the ink cartridge 40 in the handheld printer 1 or remove the ink cartridge 40 therefrom. Therefore, compared with the structure including a plurality of covers, the apparatus structure can be simple, and the apparatus can be compact.

Additionally, since the number of components to be opened by the user is smaller, the number of operation steps can be reduced in attachment and removal of the ink cartridge 40. Thus, the usability can be improved.

Figure 18:
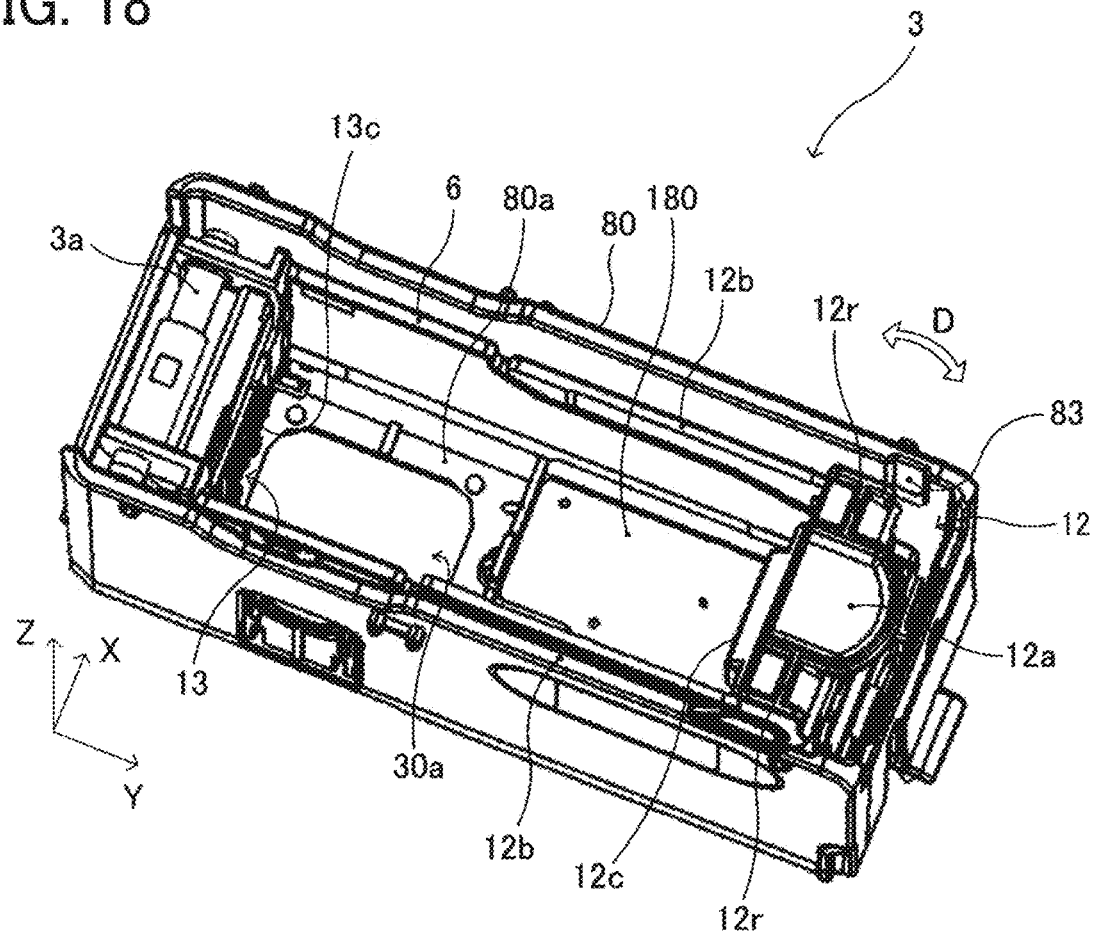
FIG. 18 is a perspective view illustrating a lower unit of the handheld printer.
Figure 19:
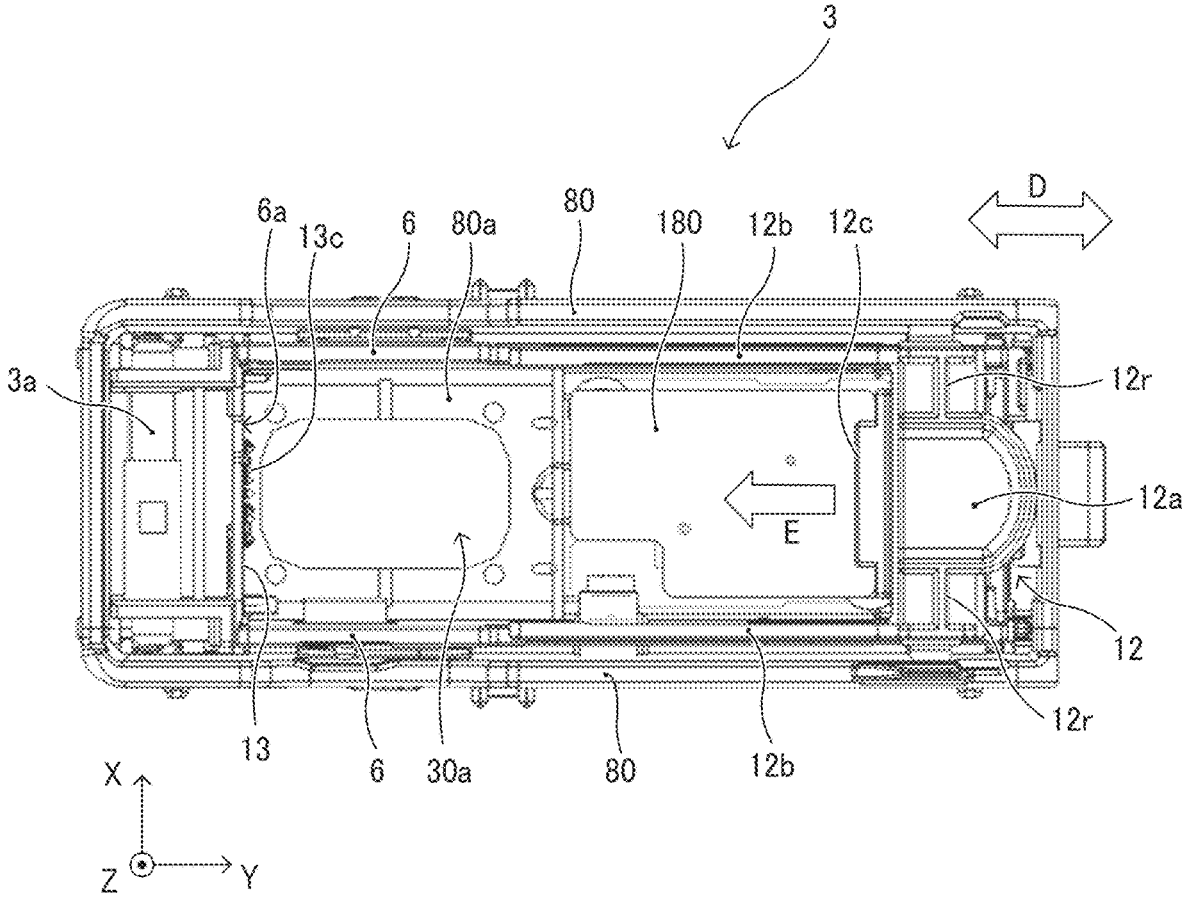
FIG. 19 is a top view of the lower unit.

FIG. 18 is a perspective view of the lower unit 3 of the handheld printer 1 in the state in which the ink cartridge 40 is removed from the handheld printer 1 and the upper unit 2 is also removed, as viewed obliquely from above on the front side. FIG. 19 is a top view of the lower unit 3 illustrated in FIG. 18.

As illustrated in FIGS. 18 and 19, the lower unit 3 includes the cartridge holder 6 that is secured inside the housing 80 and holds the ink cartridge 40.

Further, a housing bottom board 80*a* forming a bottom face of the housing 80 includes the discharge opening 30*a*. Furthermore, the housing bottom board 80*a* includes a sensor protection film 180 which covers the upper side of the position detection sensor 18 fixed to the upper surface of the housing bottom board 80*a*.

As illustrated in FIGS. 18 and 19, a space is provided inside the housing 80 of the lower unit 3 of the handheld printer 1 to set the ink cartridge 40 therein. The FPC contact 13 which electrically connects the ink cartridge 40 is disposed on the inner wall face on the rear side of the space where the ink cartridge 40 is set. The FPC contact 13 includes a flexible substrate, and the plurality of body-side connection terminals 13*c* is provided on the substrate. The body-side connection terminals 13*c* are disposed at a position to match the position of the cartridge-side connection terminals 40*c* which are the connection terminal of the ink cartridge 40 when the ink cartridge 40 is set properly.

A section including the pressing portion 12*c* (the inner wall face on the front face 35 side) faces a wall face where the FPC contact 13 is disposed on the opposite side of the space where the ink cartridge 40 is set. The section including the pressing portion 12*c* is movable in the direction indicated by an arrow D in FIGS. 18 and 19.

A large area of the inner wall face on the front face 35 side is formed by the surface of the cartridge attaching and detaching mechanism 12. As a result, when the cartridge attaching and detaching mechanism 12 rotates around the cartridge attaching and detaching mechanism rotation shaft 12*e*, the inner wall face defining the front face 35 side of the space where the ink cartridge 40 is set is movable. The cartridge attaching and detaching mechanism 12 including the pressing portion 12*c* rotates around the attaching and detaching mechanism rotation shaft 12*e*. As a result, the cartridge attaching and detaching mechanism 12 can move toward the direction (Y direction, also "facing direction") in which the FPC contact 13 and the cartridge-side contact 40*b* face each other.

The cartridge attaching and detaching mechanism 12 includes the pressing portion 12*c*. The pressing portion 12*c* is disposed at a position opposed to an outer wall surface of the front side of the ink cartridge 40. Of the moving directions indicated by the arrow D in FIGS. 18 and 19, the direction indicated by the arrow D1 in FIG. 13 is a direction moving away from a connector-side inner wall face 6*a* where the FPC contact 13 is disposed. The connector-side inner wall face 6*a* is one of inner wall faces of the apparatus body.

In order to secure an electrical connection between the ink cartridge 40 and the apparatus body, the cartridge-side connection terminals 40*c* and the body-side connection terminals 13*c* need to be in contact with each other. Therefore, the handheld printer 1 is configured to press the cartridge-side connection terminals 40*c* against the body-side connection terminals 13*c* with an appropriate force, and the pressing portion 12*c* is configured to press the ink cartridge 40 against the body-side connection terminals 13*c* in the direction indicated by arrow E in FIG. 19. As for the shape of the terminals of the electrical connection, the shape of the cartridge-side connection terminals 40*c* is flat, whereas the shape of the body-side connection terminals 13*c* is a convex shape.

Next, the positional relationship between the ink cartridge 40 and each component which forms the space in the apparatus body where the ink cartridge 40 is set is described.

Figure 20:
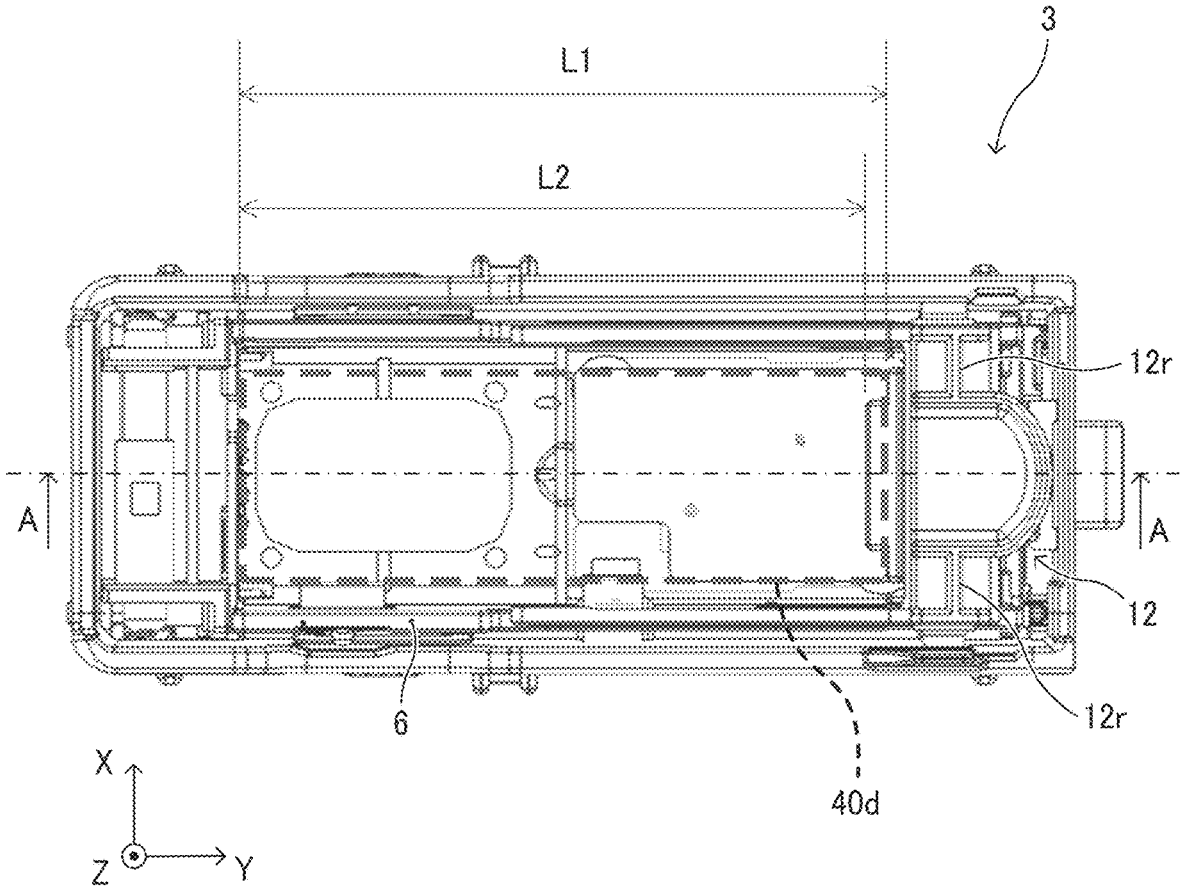
FIG. 20 is an explanatory view in which a cartridge mount region is added with a broken line to FIG. 19

FIG. 20 is a top view of the lower unit 3. In FIG. 20, a cartridge mounting area 40*d* marked by broken lines, where the ink cartridge 40 is set, is added to the top view illustrated in FIG. 19.

FIG. 1 is a cross-sectional view along line A-A illustrated in FIGS. 4 and 20 and illustrates the cartridge holder 6, the cartridge attaching and detaching mechanism 12, and the ink cartridge 40. FIG. 1 illustrates a state where the ink cartridge 40 is not mounted and the cartridge attaching and detaching mechanism 12 is positioned on a connector side where the FPC contact 13 as the apparatus body-side connector (an apparatus body-side electrical connector) is disposed. The connector side position is a position of the cartridge attaching and detaching mechanism 12 when the pressing portion 12*c* of the cartridge attaching and detaching mechanism 12 pressurizes the ink cartridge 40 mounted in the apparatus body against the rear face 34 side.

Figure 21:
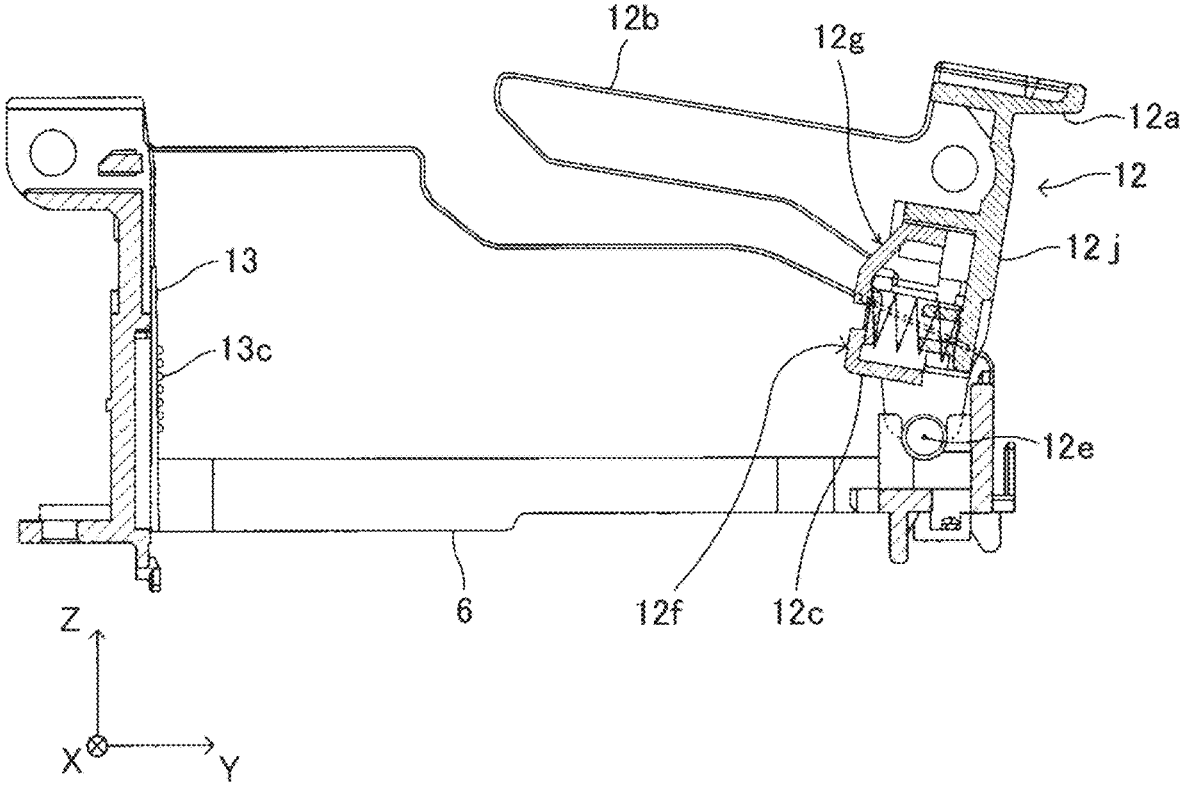
FIG. 21 is a cross-sectional view of a cartridge attaching and detaching mechanism and an ink cartridge in a state where the cartridge attaching and detaching mechanism is separated from the cartridge holder.

FIG. 21 is a cross-sectional view of the cartridge holder 6 and the cartridge attaching and detaching mechanism 12 when the cartridge attaching and detaching mechanism 12 rotates around the attaching and detaching mechanism rotation shaft 12*e* in the direction indicated by arrow D1 from a state illustrated in FIG. 1 and the cartridge attaching and detaching mechanism 12 is separated from the cartridge holder 6.

Figure 22:
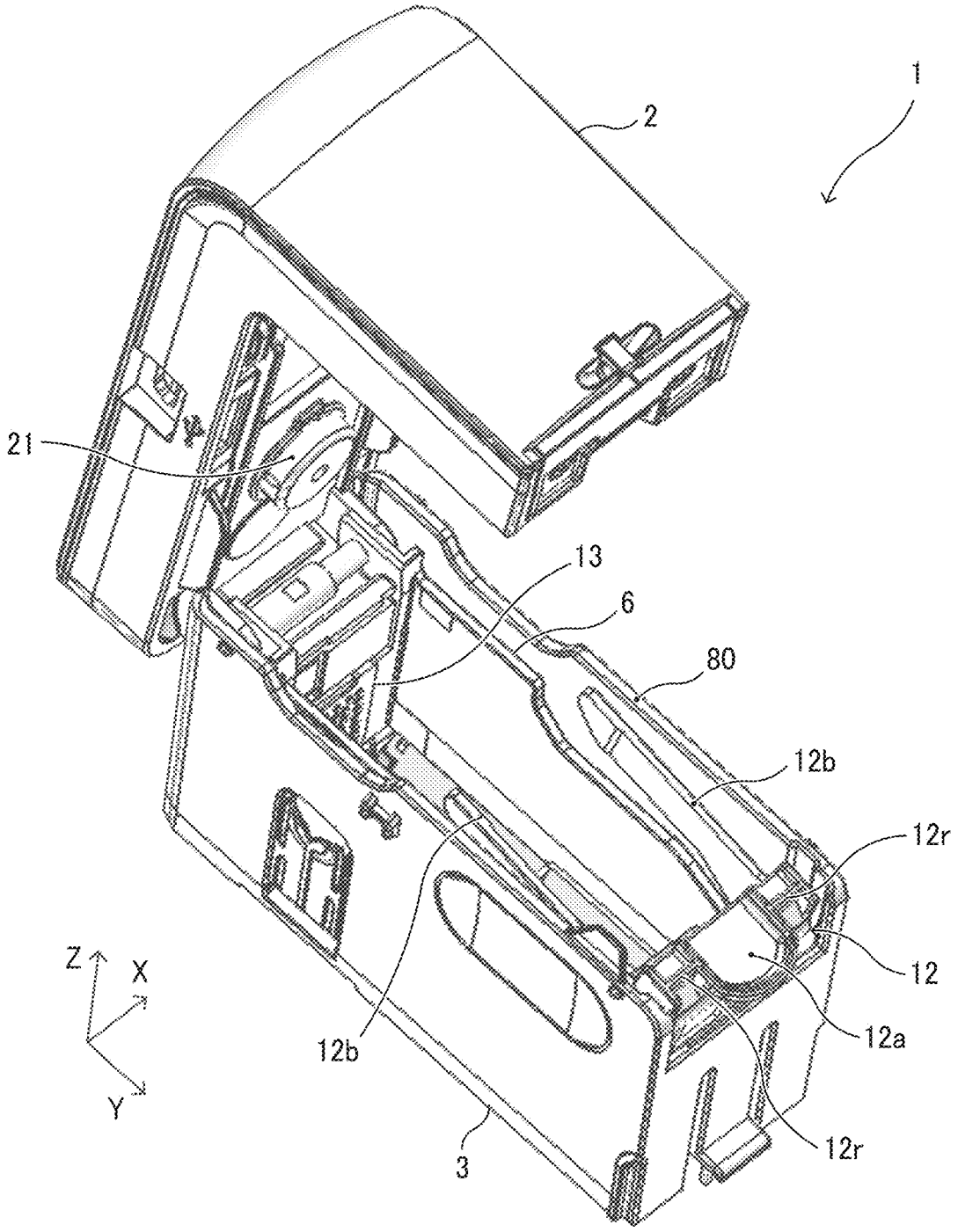
FIG. 22 is a perspective view of the handheld printer in a state where the cartridge attaching and detaching mechanism is separated from a body.

Similar to FIG. 21, FIG. 22 is a perspective view of the handheld printer 1 in a state in which the ink cartridge 40 is removed and the cartridge attaching and detaching mechanism 12 is separated from the cartridge holder 6. Similar to FIGS. 21 and 22, FIG. 23 is a cross-sectional view along line A-A illustrated in FIG. 4 of the handheld printer 1 in a state in which the ink cartridge 40 is removed and the cartridge attaching and detaching mechanism 12 is separated from the cartridge holder 6.

Figure 23:
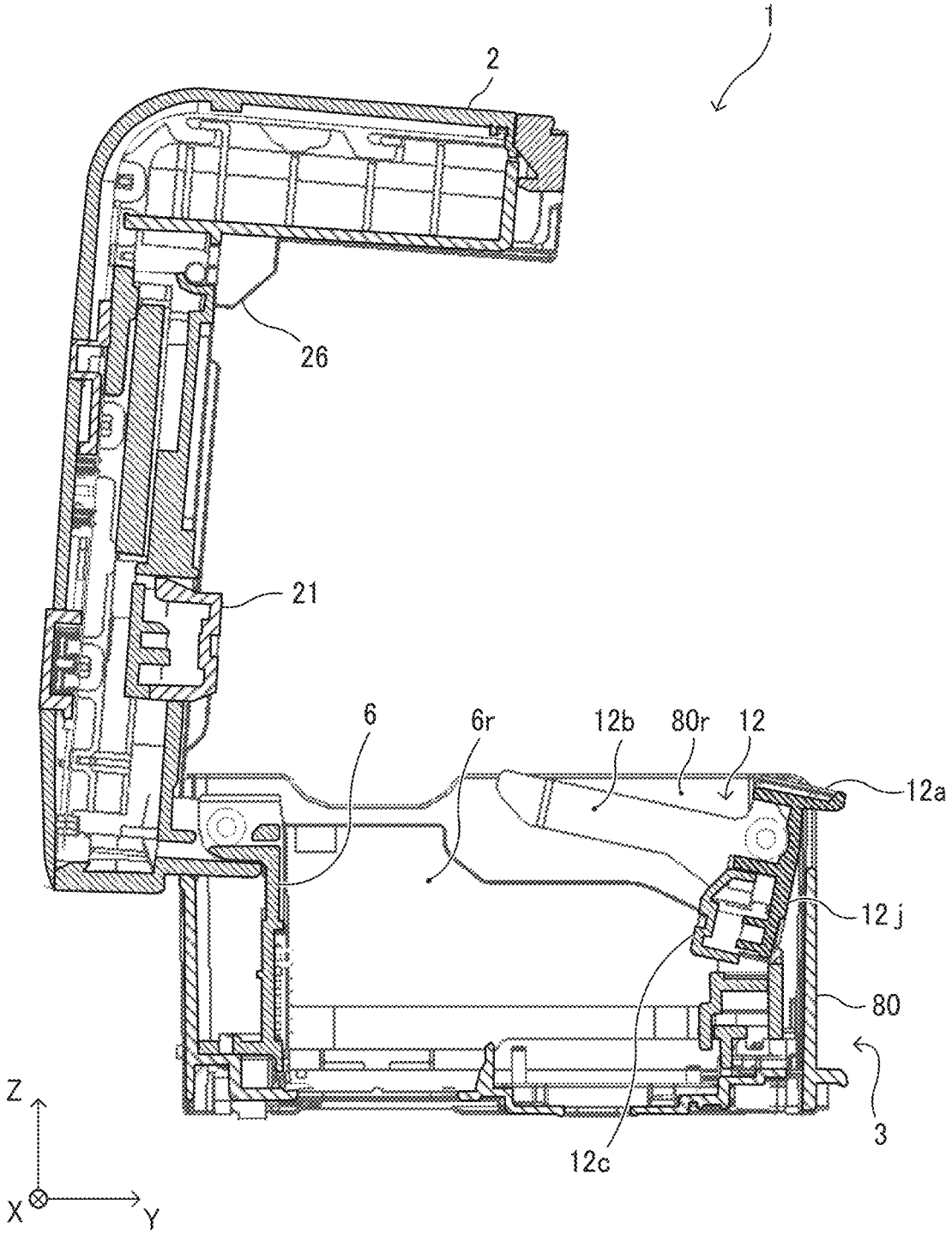
FIG. 23 is a cross-sectional view of the handheld printer in a state where the cartridge attaching and detaching mechanism is separated from the body.

FIG. 23 illustrates a wall portion 6*r* on the right face 33 side (a back side in FIG. 23) of the cartridge holder 6, and a wall portion 80*r* on the right face 33 side of the housing 80 (the back side in FIG. 23).

In a state in which the ink cartridge 40 is not mounted in the lower unit 3, the cartridge attaching and detaching mechanism 12 can move between a connector-side position illustrated in FIG. 1 (a first position) and a separated position illustrated in FIG. 21 (a second position).

Figure 24:
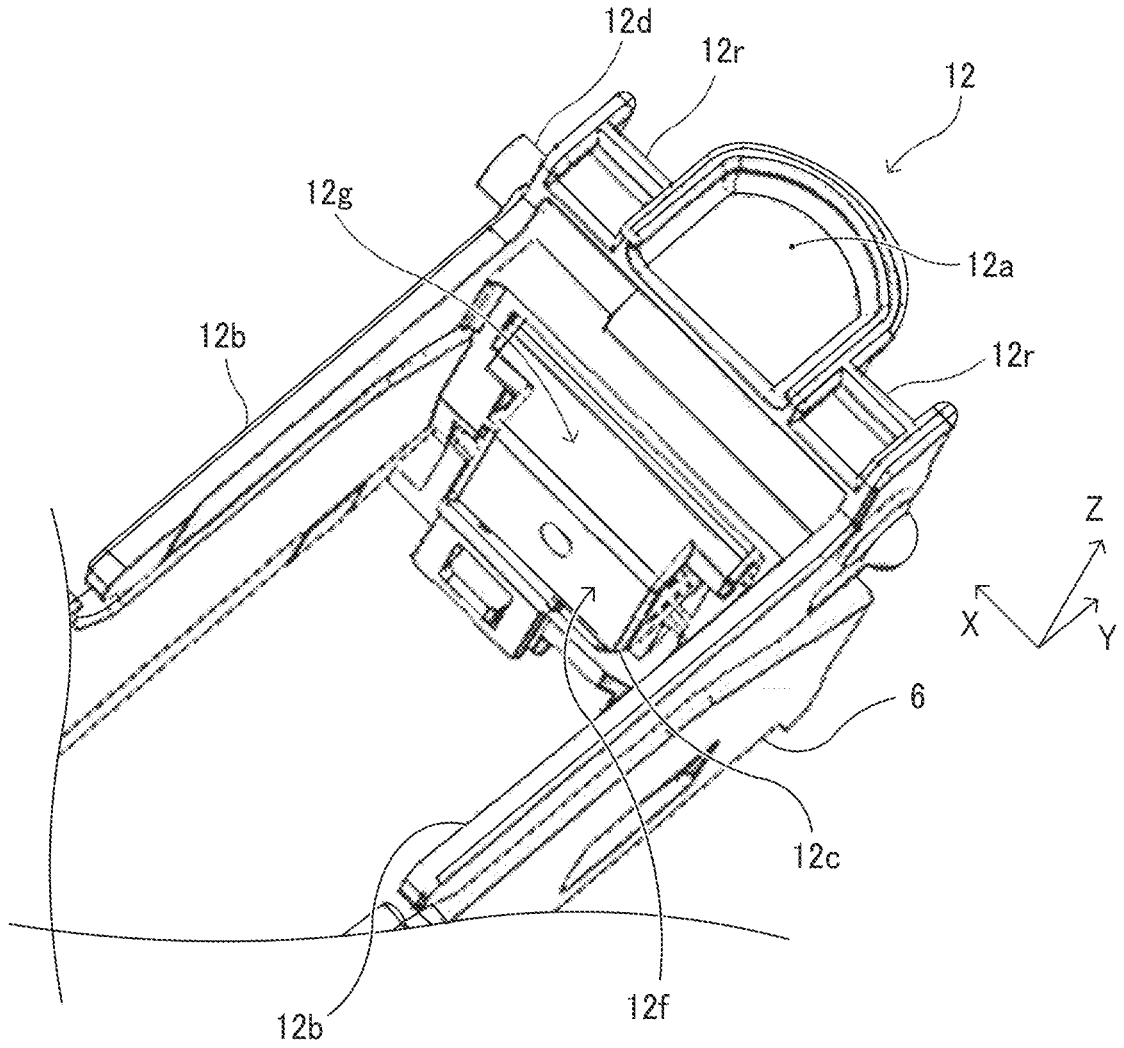
FIG. 24 is a perspective view of an end portion of a front face of the cartridge holder and the cartridge attaching and detaching mechanism in a state where the cartridge attaching and detaching mechanism is positioned on a connector side.
Figure 25:
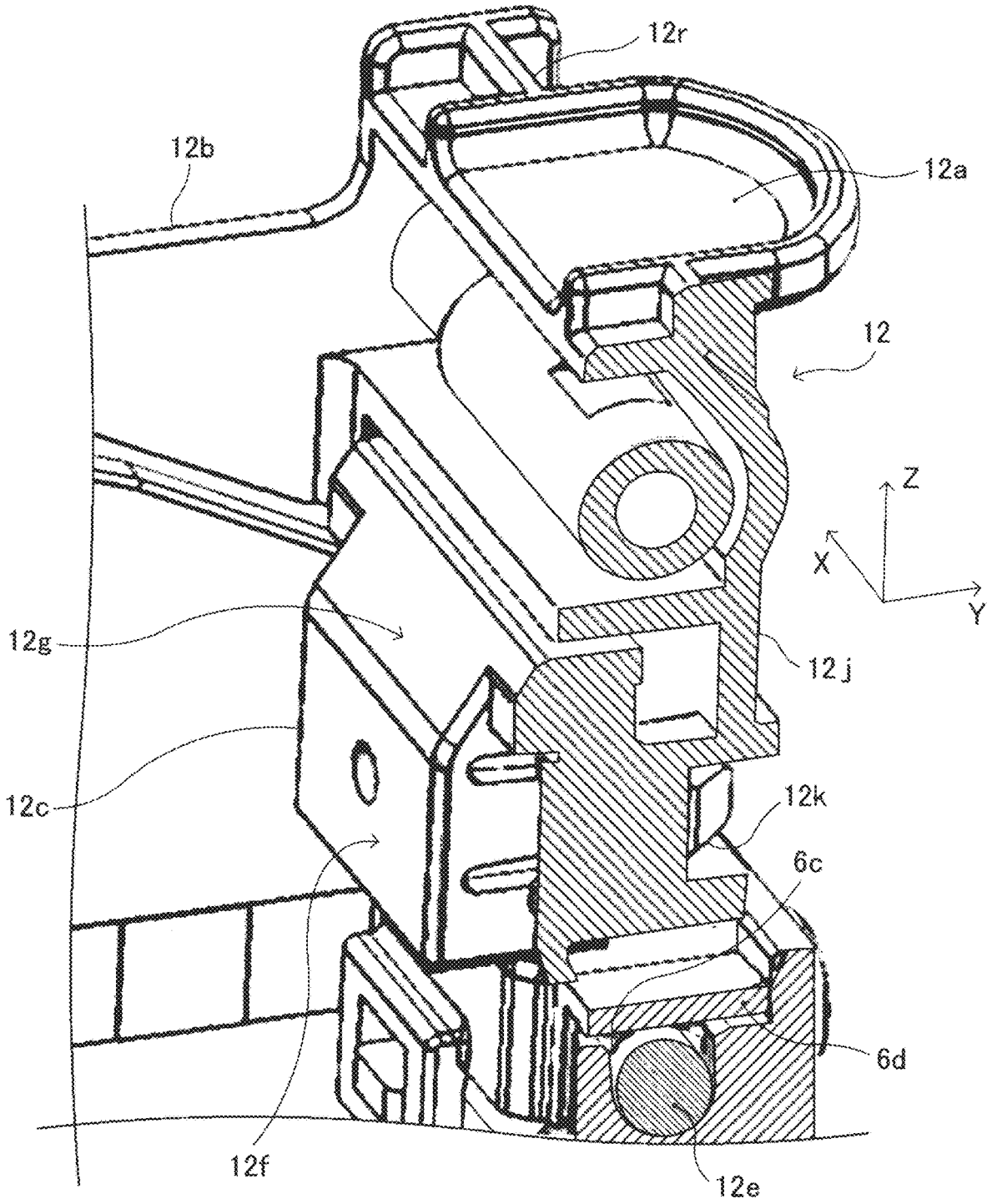
FIG. 25 is a cross-sectional perspective view of an end portion of the front face of the cartridge holder and the cartridge attaching and detaching mechanism in a state where the cartridge attaching and detaching mechanism is positioned on the connector side.

FIG. 24 is a perspective view of an end portion of the cartridge holder 6 and the cartridge attaching and detaching mechanism 12 on the front face 35 side in a state where the cartridge attaching and detaching mechanism 12 is positioned on a connector side (illustrated in FIG. 1). FIG. 25 is a cross-sectional perspective view of an end portion of the cartridge holder 6 and the cartridge attaching and detaching mechanism 12 on the front face 35 side in a state where the cartridge attaching and detaching mechanism 12 is positioned on a connector side.

As illustrated in FIGS. 1, 24, and 25, the cartridge attaching and detaching mechanism 12 includes the pressing portion 12*c*, and further includes a pressing portion holder 12*j* that slidably holds the pressing portion 12*c*. The operated portion 12*a*, the push-up lever 12*b*, and the attaching and detaching mechanism rotation shaft 12*e* are integrated with the pressing portion holder 12*j* and integral with each other as one component. In addition, this integral member forms a L-shape with the operated portion 12*a* extending in the horizontal direction in a state of being positioned on the connector side and the pressing portion holder 12*j* extending in the vertical direction.

As illustrated in FIGS. 1 and 25, the cartridge holder 6 includes a bearing recess 6*c* into which the attaching and detaching mechanism rotation shaft 12*e* is fitted. As illustrated in FIG. 25, a recess lid 6*d* is secured to the cartridge holder 6 in a state where the attaching and detaching mechanism rotation shaft 12*e* is fitted into bearing recess 6*c* and the cartridge attaching and detaching mechanism 12 is assembled with the cartridge holder 6. As a result, the attaching and detaching mechanism rotation shaft 12*e* does not come off from the bearing recess 6*c* and the cartridge holder 6 can rotatably hold the cartridge attaching and detaching mechanism 12 around the attaching and detaching mechanism rotation shaft 12*e*.

As illustrated in FIG. 1, a pressure spring 12*h* is disposed inside the pressing portion 12*c*. The pressure spring 12*h* biases the pressing portion 12*c* in a direction drawing away from the pressing portion holder 12*j*. Further, as illustrated in FIG. 25, the pressing portion 12*c* includes a claw 12*k* which is hooked to a portion of the pressing portion holder 12*j*. The pressing portion 12*c* biased by the pressure spring 12*h* moves in the direction drawing away from the pressing portion holder 12*j*. However, when the pressing portion 12*c* reaches the position illustrated in FIG. 25, the claw 12*k* is hooked to the pressing portion holder 12*j*. As a result, it is possible to prevent the pressing portion 12*c* from further moving away from the pressing portion holder 12*j* (left side of FIG. 25) than a state illustrated in FIG. 25.

As illustrated in FIGS. 1, 24, and 25, the pressing portion 12*c* includes a pressing face 12*f* and an inclined face 12*g*. The pressing face 12*f* contacts and presses the outer wall surface of the mounted ink cartridge 40 on the front face 35 side. The inclined face 12*g* is positioned above the pressing face 12*f* and inclined with respect to the pressing face 12*f*. At that time, the inclined face 12*g* is inclined upward. In a state where the cartridge attaching and detaching mechanism 12 is positioned on the connector side, the pressing face 12*f* is substantially parallel to the Z-X plane and the inclined face 12*g* is inclined with respect to the pressing face 12*f*.

As illustrated in FIGS. 1 and 20, the cartridge-side contact 40*b* (See FIG. 15) is at a distance L1 from the opposite side of the cartridge-side contact 40*b* on the outer wall surface of the ink cartridge 40. The distance L1 is referred to as "cartridge-side pressure connection distance L". When the distance from the connector-side inner wall face 6*a* on the apparatus body side to the pressing face 12*f* of the pressing portion 12*c* is referred to as "main-body-side pressure connection distance L2", the relationship there between is represented as L1>L2.

Figure 26:
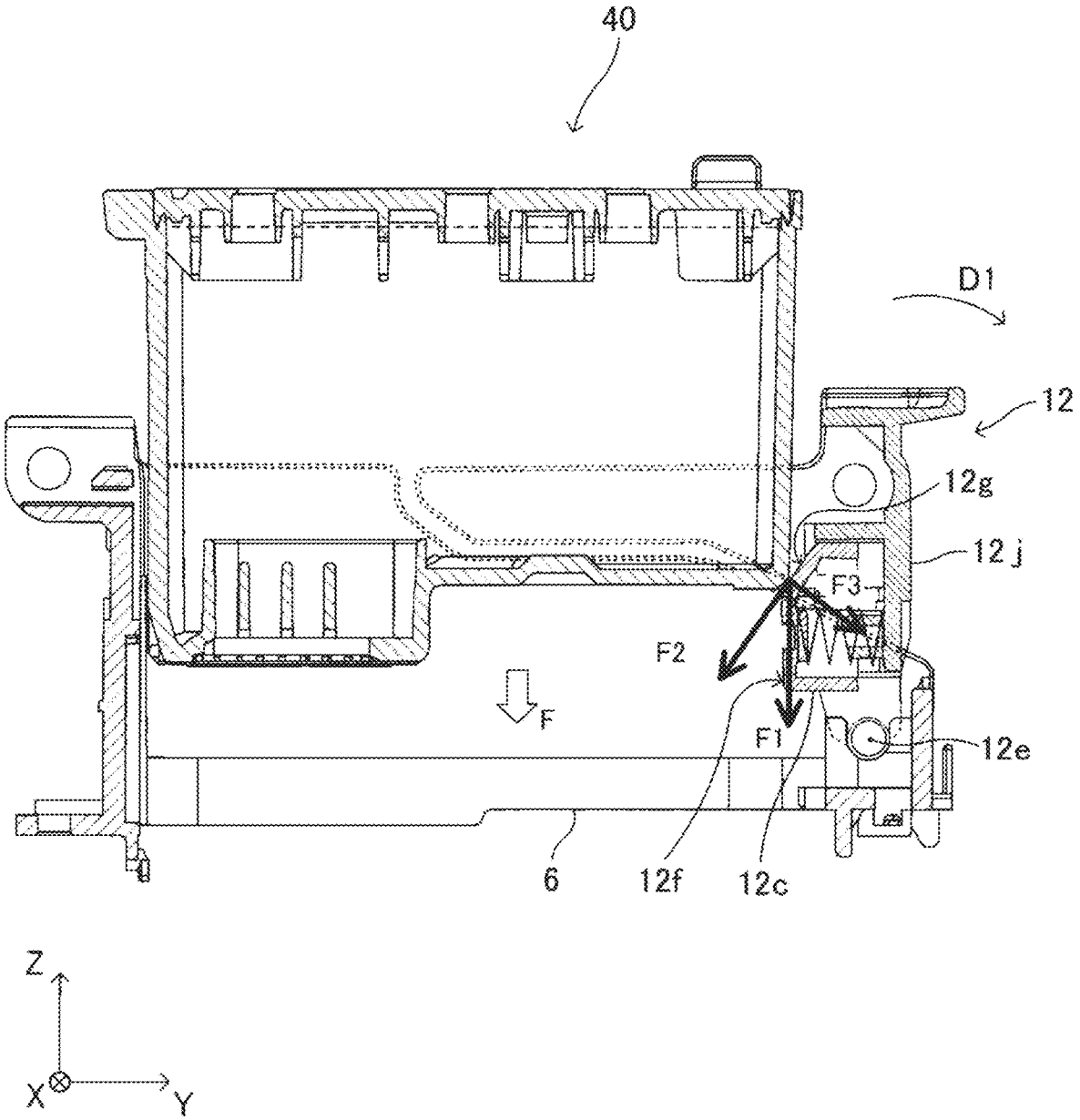
FIG. 26 is a cross-sectional view of the handheld printer in a state where the ink cartridge contacts a pressing portion.

FIG. 26 is a cross-sectional view illustrating a state where the ink cartridge 40 is inserted into the lower unit 3 and the ink cartridge 40 reaches the pressing portion 12*c* from the state illustrated in FIG. 1.

When the ink cartridge 40 is inserted with the outer wall surface provided with the cartridge-side contact 40*b* being moved along the connector-side inner wall face 6*a*, due to the relationship of L1>L2, the ink cartridge 40 contacts the pressing portion 12*c* as illustrated in FIG. 26. At this time, as indicated by an arrow F in FIG. 26, the ink cartridge 40 is inserted vertically downward, contacts the inclined face 12*g* of the pressing portion 12*c*, and applies a vertically downward force F1.

Since the inclined face 12*g* is inclined relative to the vertical direction, the force F1 acts on the pressing portion 12*c* as a component force F2 and a component force F3.

The component force F2 acts in a direction along the inclined face 12*g*, but a surface of the inclined face 12*g* and a surface of the ink cartridge 40 are smooth. Therefore, it is not necessary to consider a friction force between the members that acts in the direction along the surface. It is also not necessary to consider a rotation moment which the component force F2 applies on the pressing portion 12*c* around the attaching and detaching mechanism rotation shaft 12*e* in the counterclockwise direction in FIG. 26.

On the other hand, as the component force F3 acts on the pressing portion 12*c*, the pressing portion holder 12*j* is pushed by the component force F3 via the pressing portion 12*c* and the pressure spring 12*h*. As a result, the pressing portion holder 12*j* rotates in the direction indicated by arrow D1 in FIG. 26 by the rotation moment which acts on the pressing portion holder 12*j* around the attaching and detaching mechanism rotation shaft 12*e* in the clockwise direction.

At this time, the pressing portion 12*c* is in contact with the outer wall surface of the ink cartridge 40 on the front face 35 side, but the claw 12*k* is still hooked by the pressing portion holder 12*j*. For this reason, the biasing force of the pressure spring 12*h* does not act on the ink cartridge 40.

Figure 27:
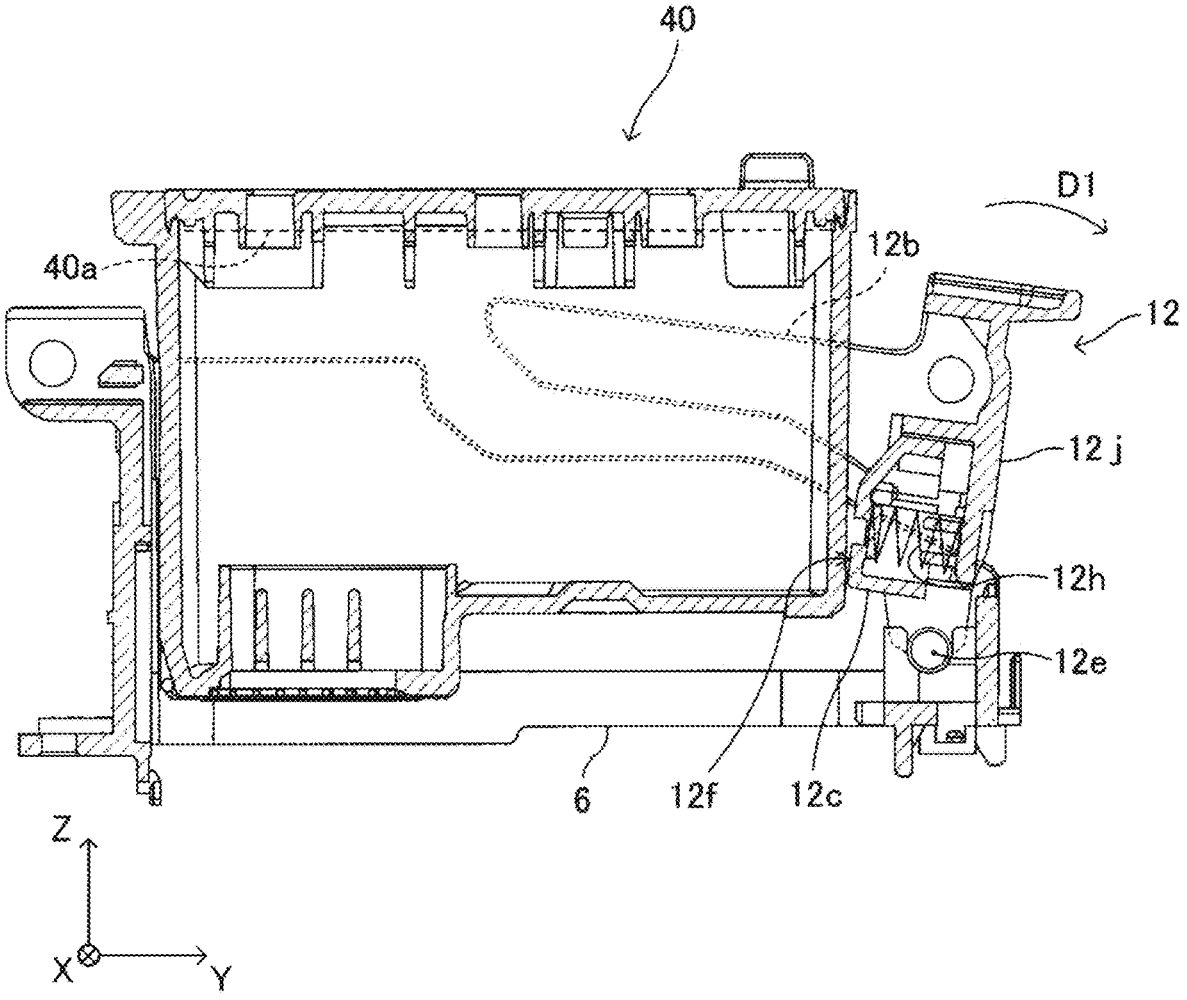
FIG. 27 is a cross-sectional view of the handheld printer in a state where the ink cartridge is inserted into the cartridge holder from the state illustrated in FIG. 26.

FIG. 27 is a cross-sectional view illustrating a state where the ink cartridge 40 is inserted further into the cartridge holder 6 from the state illustrated in FIG. 26.

When the ink cartridge 40 is inserted further from the state illustrated in FIG. 26, the contact portion with the ink cartridge 40 moves from the inclined face 12*g* to the pressing face 12*f* and the pressing face 12*f* contacts the ink cartridge 40. When the ink cartridge 40 contacts the inclined face 12*g* and the pressing portion holder 12*j* rotates in the direction of the arrow D1, the ink cartridge 40 contacts the pressing face 12*f*. At this time, the surface of the pressing face 12*f* faces obliquely upward. Therefore, when the ink cartridge 40 is inserted further after the ink cartridge 40 contacts the pressing face 12*f*, the pressing portion holder 12*j* rotates in the direction of the arrow D1 as illustrated in FIG. 27. In the state illustrated in FIG. 27, the biasing force of the pressure spring 12*h* does not act on the ink cartridge 40.

Figure 28:
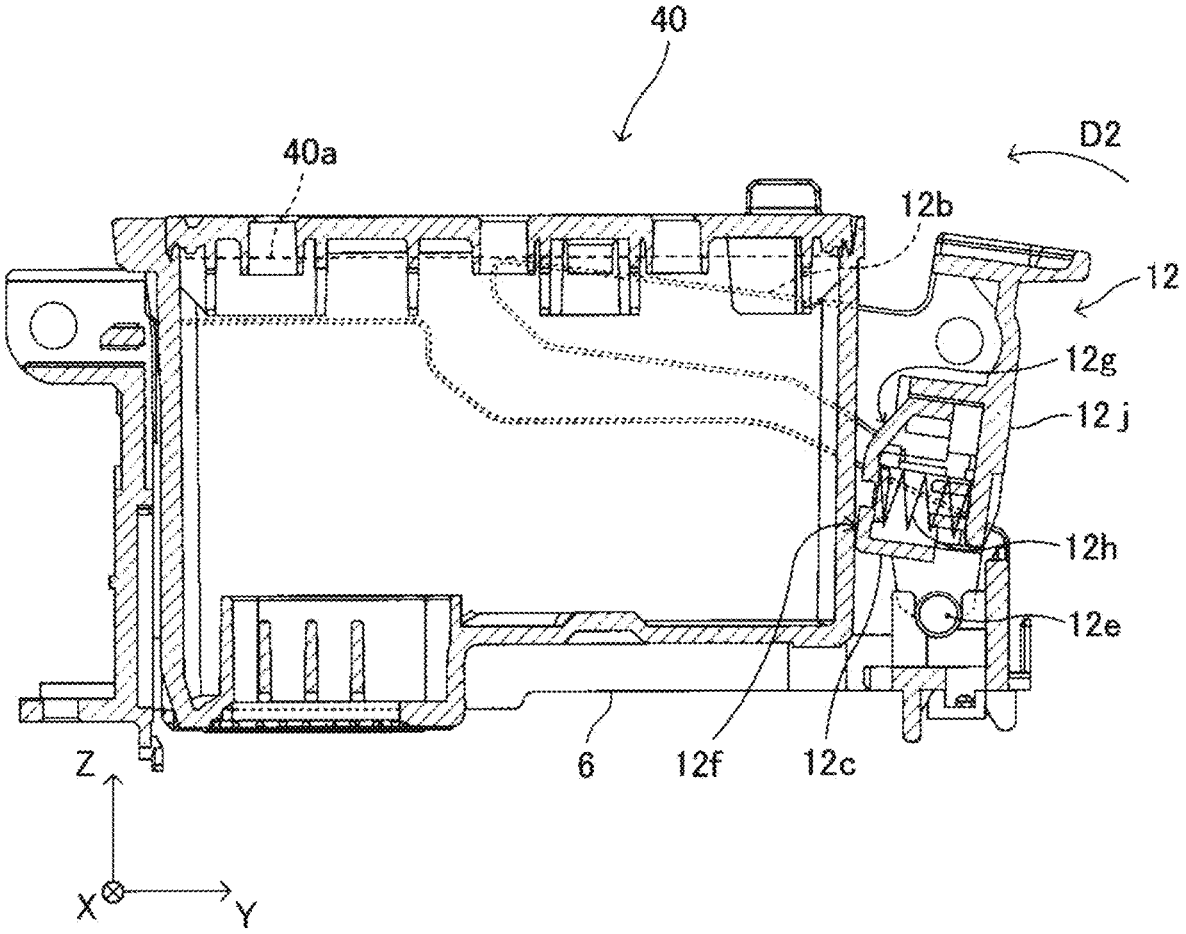
FIG. 28 is a cross-sectional view of the handheld printer in a state where a flange portion of the ink cartridge contacts a push-up lever.

FIG. 28 is a cross-sectional view illustrating a state where the flange portion 40*a* of the inserted ink cartridge 40 contacts the push-up lever 12*b*.

When the ink cartridge 40 is inserted further into the cartridge holder 6 from the state illustrated in FIG. 27, the flange portion 40*a* contacts the push-up lever 12*b* as illustrated in FIG. 28. When the ink cartridge 40 is inserted further, the flange portion 40*a* presses the push-up lever 12*b* downward and the pressing portion holder 12*j* combined with the push-up lever 12*b* rotates in the direction of the arrow D2 as illustrated in FIG. 28. By this rotation, a relative distance between the ink cartridge 40 and the pressing portion holder 12*j* narrows and the pressure spring 12*h* is compressed. Then, the biasing force of the pressure spring 12*h* starts acting on the ink cartridge 40 via the pressing portion 12*c*.

Figure 29:
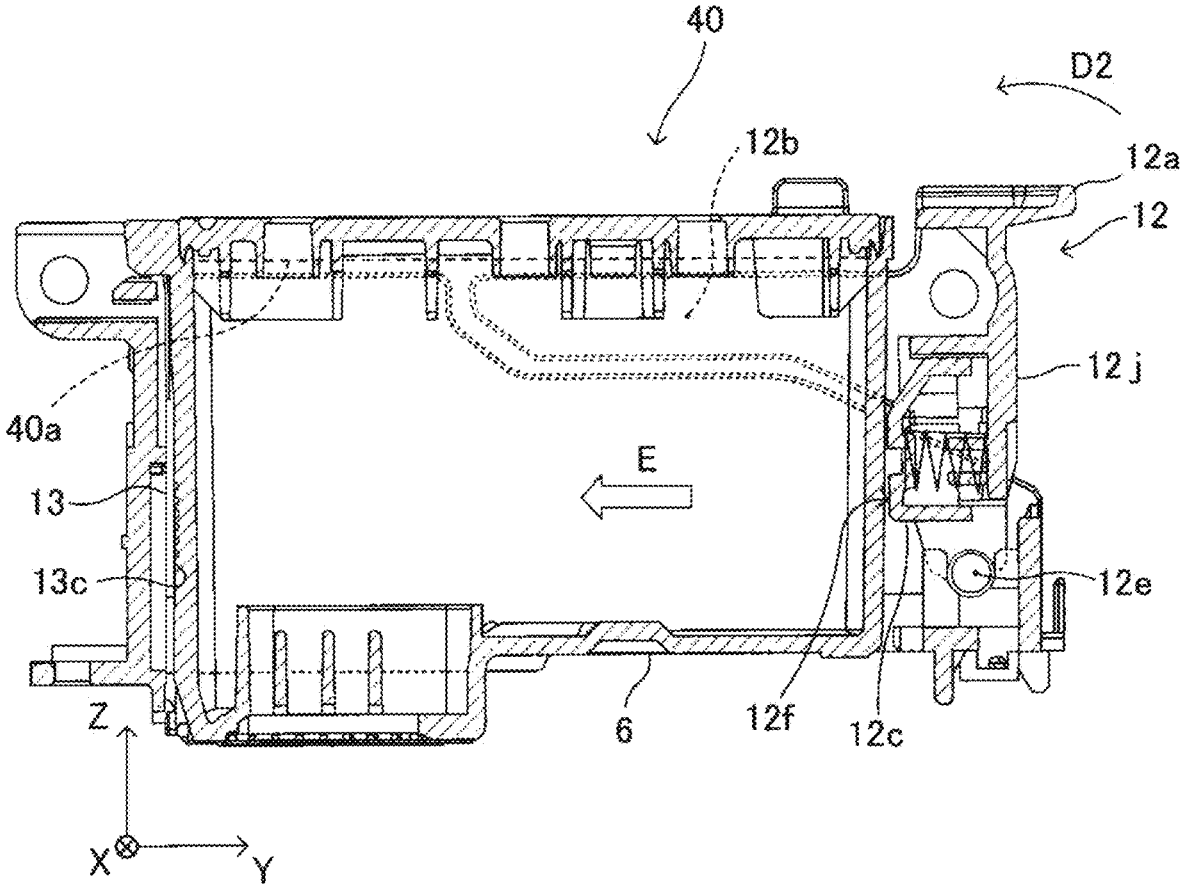
FIG. 29 is a cross-sectional view of the handheld printer in a state where the mounting of the ink cartridge is complete.

FIG. 29 is a cross-sectional view of the ink cartridge 40 and the cartridge holder 6 in a state where the mounting of the ink cartridge 40 is completed.

As the ink cartridge 40 is inserted further from the state illustrated in FIG. 28, the biasing force of the pressure spring 12*h* increases. At this time, when the pressing face 12*f* inclines relative to an outer wall surface of the front face 35 side of the ink cartridge 40 and partially contacts the outer wall surface, there arises force that causes the pressing face 12*f* to contact the outer wall surface of the ink cartridge 40 in parallel. With such force, even when the push-up lever 12*b* is not pushed downward by the flange portion 40*a*, the pressing portion holder 12*j* rotates in the direction of the arrow D2 as illustrated in FIGS. 28 and 29, and the pressing portion holder 12*j* reaches the connector-side position and the pressing portion holder 12*j* is in the state illustrated in FIG. 29. Therefore, as illustrated in FIG. 29, even when the flange portion 40*a* is not in contact with the push-up lever 12*b*, the pressing portion holder 12*j* can rotate and reach the connector-side position.

Both the cartridge attaching and detaching mechanism 12 illustrated in FIG. 1 and the cartridge attaching and detaching mechanism 12 in FIG. 29 are positioned on the connector side. However, the pressing portion 12*c* in the state illustrated in FIG. 29 is positioned closer to the front face 35 side (right side in the drawing) than the pressing portion 12*c* in the state illustrated in FIG. 1, and the pressure spring 12*h* is compressed in the state illustrated in FIG. 29. As a result, in the state illustrated in FIG. 29, the biasing force of the pressure spring 12*h* acts on the pressing portion 12*c* and the pressing portion 12*c* pressurizes the ink cartridge 40 to the rear face 34 side (arrow E direction in FIG. 29).

As indicated by the arrow E in FIG. 29, the pressing direction by the pressing portion 12*c* is substantially parallel to the Y direction. Further, as indicated by an arrow F in FIG. 26, the insertion direction of the ink cartridge 40 is substantially parallel to the Z direction. As a result, the pressurizing direction by the pressing portion 12 *c* is substantially orthogonal to the insertion direction of the ink cartridge 40.

The pressing portion 12*c* can apply pressure on the cartridge-side contact 40*b* provided on the outer wall surface on the rear face 34 side of the ink cartridge 40 toward the FPC contact 13 provided on the inner wall face on the rear face 34 side of the apparatus body. As a result, the cartridge-side connection terminals 40*c* of the cartridge-side contact 40*b* and the body-side connection terminals 13*c* of the FPC contact 13 can be connected with an appropriate contact pressure.

As illustrated in FIGS. 1, 26 and 29, when the ink cartridge 40 is set, the ink cartridge 40 is moved down toward the apparatus body (the cartridge holder 6 secured in the housing 80) and set in a predetermined position in the cartridge holder 6.

When the ink cartridge 40 is set in this manner, the ink cartridge 40 may be set in a state where the cartridge attaching and detaching mechanism 12 is positioned closer to the front face 35 side of the FPC contact 13 as illustrated in FIG. 1, that is, in a state where the cartridge attaching and detaching mechanism 12 is positioned on the connector side. The length of the ink cartridge 40 in the pressing direction is longer than a distance between the FPC contact 13 secured on the cartridge holder 6 and the pressing face 12*f* of the pressing portion 12*c* in a state where the cartridge attaching and detaching mechanism 12 is at the connector-side position. That is, the cartridge-side pressure connection distance L1 that is the length of the ink cartridge 40 in the pressing direction is longer than the body-side pressure connection distance L2. Therefore, when the user tries to mount the ink cartridge 40 with the cartridge attaching and detaching mechanism 12 positioned at the connector-side position, the ink cartridge 40 contacts the pressing portion 12*c*.

A surface adjacent to the pressing face 12*f* and above the pressing face 12*f* is the inclined face 12*g* inclined relative to the pressing face 12*f*. When the ink cartridge 40 is set, the ink cartridge 40 contacts the inclined face 12*g* of the pressing portion 12*c*. Therefore, even when the cartridge attaching and detaching mechanism 12 is at the connector-side position and closed, the ink cartridge 40 can be set while the ink cartridge 40 pushes the cartridge attaching and detaching mechanism 12 outward (moving the cartridge attaching and detaching mechanism 12 to the separated position). As a result, the cartridge attaching and detaching mechanism 12 moves away from the connector-side position on the FPC contact 13 side. As a result, when the ink cartridge 40 is set, the FPC contact 13 and the cartridge-side contact 40*b* move alongside with each other in a state where pushing pressure is being applied such that the body-side connection terminals 13*c* and the cartridge-side contact 40*b* contact each other. Thus, rubbing between the FPC contact 13 and the cartridge-side contact 40*b* can be restrained. Therefore, this mechanism can inhibit damage caused by rubbing between the FPC contact 13 and the cartridge-side contact 40*b*.

As described above, in the handheld printer 1 according to the present embodiment, since the ink cartridge 40 is pressed against the FPC contact 13 side while the ink cartridge 40 is mounted, rubbing between the FPC contact 13 and the cartridge-side contact 40*b* in a pressed state can be restrained. This arrangement can inhibit damage of either the FPC contact 13 or the cartridge-side contact 40*b* or both caused by the rubbing.

After the ink cartridge 40 is mounted, if the ink cartridge 40 is not pressed against the FPC contact 13, an appropriate connection state is not secured. Further, the handheld printer 1 is operated and moved by the user's hand with the ink cartridge 40 mounted therein. It is required to maintain electrical connection while the handheld printer 1 is being moved and the ink cartridge 40 needs to be pushed against the FPC contact 13 with a certain pressing force.

In the handheld printer 1 according to the present embodiment, by satisfying the relation expressed by L1>L2, the pressing portion 12*c* presses the ink cartridge 40 against the FPC contact 13 with the ink cartridge 40 mounted therein, and the FPC contact 13 and the cartridge-side contact 40*b* is properly connected.

Further, as the cartridge attaching and detaching mechanism 12 including the pressing portion 12*c* is movable from the connector-side position to the separated position, when the ink cartridge 40 is set, rubbing between the FPC contact 13 and the cartridge-side contact 40*b* in the pressed state can be restrained. This mechanism can inhibit damage of either the FPC contact 13 or the cartridge-side contact 40*b* or both caused by the rubbing.

As described above, in the handheld printer 1 according to the present embodiment, while maintaining a proper connection between electrical connectors in the state where the ink cartridge 40 is mounted, it is possible to inhibit the damage of the electrical connectors when the ink cartridge 40 is mounted.

As described above, when the ink cartridge 40 is mounted in the state where the cartridge attaching and detaching mechanism 12 is at the connector-side position, the cartridge attaching and detaching mechanism 12 moves to the separated position. As a result, even when the cartridge attaching and detaching mechanism 12 is at any position between the connector-side position and the separated position in a state in which the ink cartridge 40 is not mounted, it is possible to mount the ink cartridge 40 in the apparatus body while inhibiting the damage to the electrical connectors.

In the present embodiment, the inclined face 12*g* is provided. The inclined face 12*g* is a planar inclined face such that a ridgeline portion at the upper end of the pressing face 12*f* of the pressing portion 12*c* is chamfered. The upper end of the pressing face 12*f* of the pressing portion 12*c* is not limited to be made chamfered, but can be made as a round shape.

Compared to a conventional inkjet serial printer, a handy mobile printer (image forming apparatus) such as the handheld printer 1 can dispense with a tray for setting paper sheets, a paper conveyance device for sheet conveyance, and a head scanning device to scan with a print head on paper sheets. Furthermore, an ink supply device that supplies ink to a print head and a maintenance device that eliminates clogging of nozzles in the print head can be omitted. A handheld mobile printer such as the handheld printer 1 is capable of scanning alongside a print target area and printing on a sheet of paper freehand, thus achieving both convenience in mobility and sheet handling capability.

Handy mobile printers can include a print object detection sensor that detects the presence of a print object in a print area facing a line head. The line head is driven only when the print object detection sensor detects the print object. Such a mechanism prevents printing when the line head is not facing the print object.

In one type of electrical connectors widely used for handy mobile inkjet printers, a plurality of connection points is provided on a substrate positioned on one side face of an ink cartridge. For the electrical connection between a cartridge and a printer body, the following configuration can be employed. The printer body includes an electric connector having a projection corresponding to a cartridge-side connector, and a pressure is applied to a face of the cartridge opposite to a face on which the cartridge-side electric connector is provided. Pressure is applied to the face of the cartridge opposite to the face on which the cartridge-side electric connector is provided. Thus, it is possible to connect the cartridge-side electrical connector to the body-side electrical connector with a proper contact pressure, securing an electrical connection with the cartridge.

However, there is a risk in a configuration in which a cartridge is pressed against a body-side electrical connector. When the cartridge-side electrical connector is pressed against the body-side electrical connector while the cartridge is being set, both of the electrical connectors rub against each other. As a result, the shape of the connectors may be deformed, connector terminals may peel off, or the connectors may be damaged, leading to a poor electrical contact.

Further, to prevent electrical connectors from rubbing each other, the printer body may be configured not to press the cartridge against the body-side electrical connector when the cartridge is inserted and, instead, include a pressurizing mechanism to press the cartridge after the cartridge is set. In such a configuration, it is necessary to provide the pressurizing mechanism as a single device for the switching to the pressurized state after the cartridge is set. The size of the printer body may become large and the operability and portability of the user may be impaired.

In the handheld printer 1 according to the present embodiment, the ink cartridge 40 is held inside the lower unit 3 which is the main body. The ink cartridge 40 includes the cartridge-side contact 40*b*. The cartridge-side contact 40*b* is an electrical connector (an attachment-side connector) which includes at least one connector (cartridge-side connection terminals 40*c*) on the side face on the rear face 34 side. The cartridge holder 6, which is a cartridge holder of the lower unit 3, includes the FPC contact 13. The FPC contact 13 is the apparatus body-side connector disposed at a position corresponding to the cartridge-side contact 40*b* on the connector-side inner wall face 6*a*, one of the inner side faces. Further, the cartridge attaching and detaching mechanism 12 is provided. The cartridge attaching and detaching mechanism 12 including the pressing portion 12*c* is positioned on a wall face facing the FPC contact 13 and the wall face is one of wall faces defining the space to accommodate the ink cartridge 40. The cartridge attaching and detaching mechanism 12 is movable as a movable member relative to the FPC contact 13.

In the handheld printer 1 according to the present embodiment, the direction in which the cartridge-side contact 40*b* and the FPC contact 13 face each other is orthogonal to the direction in which the ink cartridge 40 is inserted into the apparatus body. The cartridge-side contact 40*b* is an electrical connector on the ink cartridge 40 side. Further, the pressing portion 12*c* is provided in the cartridge attaching and detaching mechanism 12. The pressing portion 12*c* pressurizes the ink cartridge 40 toward the FPC contact 13 and is a movable member that can move in a direction away from the FPC contact 13.

The body-side pressure connection distance L2 is shorter than the cartridge-side pressure connection distance L1. As a result, in a state in which the ink cartridge 40 is mounted, the pressing portion 12*c* is moved in a direction in which the pressing portion 12*c* compresses the pressure spring 12*h* against the pressing portion holder 12*j* of the cartridge attaching and detaching mechanism 12. By this mechanism, biasing force of the pressure spring 12*h* acts on the ink cartridge 40 via the pressing portion 12*c* to pressurize the ink cartridge 40 toward the connector-side inner wall face 6*a*. Therefore, in a state in which the ink cartridge 40 is mounted, the cartridge-side contact 40*b* can be connected with the FPC contact 13 with a proper contact pressure and the stable electrical connection between the ink cartridge 40 and the handheld printer 1 can be secured.

Further, the cartridge attaching and detaching mechanism 12 including the pressing portion 12*c* is a movable member that can move in a direction away from the FPC contact 13. As a result, in a state in which the ink cartridge 40 is mounted, when the user tries to set the ink cartridge 40, the cartridge attaching and detaching mechanism 12 becomes movable in the direction moving away from the FPC contact 13. As a result, when the ink cartridge 40 is set, it is possible to restrain the FPC contact 13 and the cartridge-side contact 40*b* from rubbing each other and prevent damage to the electrical connectors.

Further, the cartridge attaching and detaching mechanism 12 includes the push-up lever 12*b*. The push-up lever 12*b* is pushed down after the push-up lever 12*b* contacts a bottom side of the flange portion 40*a* of the ink cartridge 40 by the mounting operation of the ink cartridge 40. Therefore, it is possible to move the cartridge attaching and detaching mechanism 12 in conjunction with the mounting operation of the ink cartridge 40 from the separated position to the connector-side position, thus pressurizing the mounted ink cartridge 40 with the pressing portion 12*c*.

As the cartridge attaching and detaching mechanism 12 in conjunction with the mounting operation of the ink cartridge 40 is moved from the separated position to the connector-side position, it is no longer necessary to provide a pressurizing mechanism that switch the ink cartridge 40 to the pressurized state after mounting the ink cartridge 40. As a result, without increasing the size of the apparatus body, it is possible to reduce the damage to the electrical connectors when mounting the cartridge, and to secure a stable electrical connection between the cartridge and the main unit after mounting.

The cartridge attaching and detaching mechanism 12 includes the cantilever-shaped push-up levers 12*b*. The push-ups levers 12*b* protrude from the pressing portion holder 12*j* of the cartridge attaching and detaching mechanism 12 to the rear face 34 side. As illustrated in FIGS. 18 and 20, the push-up levers 12*b* are disposed on both sides of the cross direction (X direction) sandwiching the cartridge mounting area 40*d*. Further, above the pressing portion holder 12*j* of the cartridge attaching and detaching mechanism 12, the operated portion 12*a* is provided such that the user can operate the cartridge attaching and detaching mechanism 12. The operated portion 12*a* is a pushed portion. When the user pushes the operated portion 12*a*, the cartridge attaching and detaching mechanism 12 rotates around the attaching and detaching mechanism rotation shaft 12*e* to the front face 35 side (Arrow D1 direction).

Figure 30:
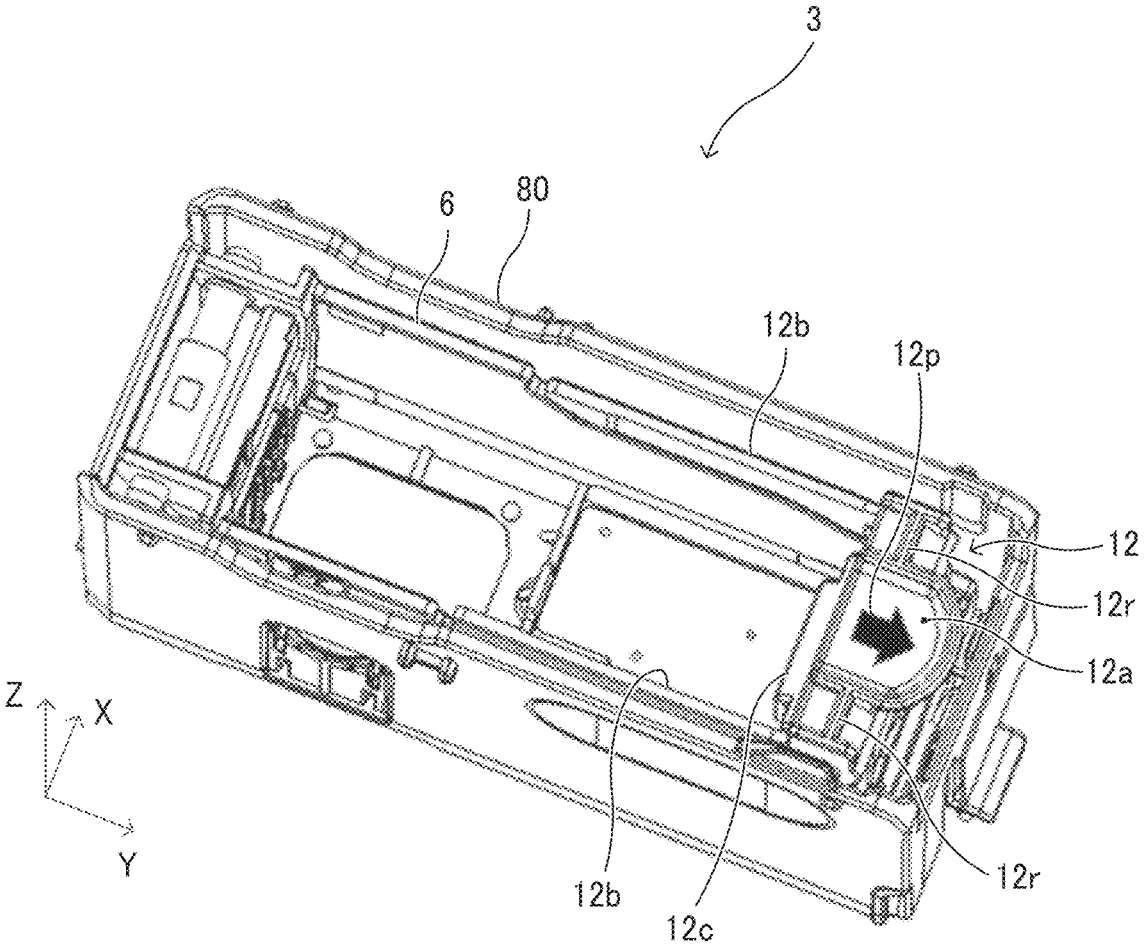
FIG. 30 is a perspective view of the lower unit illustrated in FIG. 18 in which a pushing direction indicator is added.

As illustrated in FIG. 30, the lower unit 3 can further include an arrow-shaped pressing direction indicator 12*p* on the operated portion 12*a* such that the user can easily recognize the push direction. For example, the pushing direction indicator 12*p* is printed with a paint on a component forming the operated portion 12*a*. Alternatively, the pushing direction indicator 12*p* can be an arrow-shaped recess or projection on the surface of the component.

As illustrated in FIGS. 11, 13 and 29, in a state in which the ink cartridge 40 is mounted in the apparatus body, the push-up lever 12*b* is positioned below the flange portion 40*a* which is a part of the ink cartridge 40. When the user pushes the operated portion 12*a* from this state, the cartridge attaching and detaching mechanism 12 rotates to the front face 35 side (in the direction of arrow D1 in the figure) and moves away to the separated position from the FPC contact 13, and the tip end side of the cantilevered push-up lever 12*b* rises. As the cartridge attaching and detaching mechanism 12 moves to the separated position away from the FPC contact 13, pressing force against the ink cartridge 40 toward the FPC contact 13 is released. Further, as the tip end side of the push-up lever 12*b* rises, the top face of the push-up lever 12*b* acts as a cartridge push-up face to push up a bottom face of the flange portion 40*a* and push the ink cartridge 40 upward. As a result, as illustrated in FIGS. 12 and 17, the ink cartridge 40 pops up and the user can take out the ink cartridge 40 with a hand.

As described above, in the handheld printer 1 according to the present embodiment, as the user pushes the operated portion 12*a*, pressing force against the ink cartridge 40 toward the FPC contact 13 side is released and the ink cartridge 40 is pushed upward.

Figure 31:
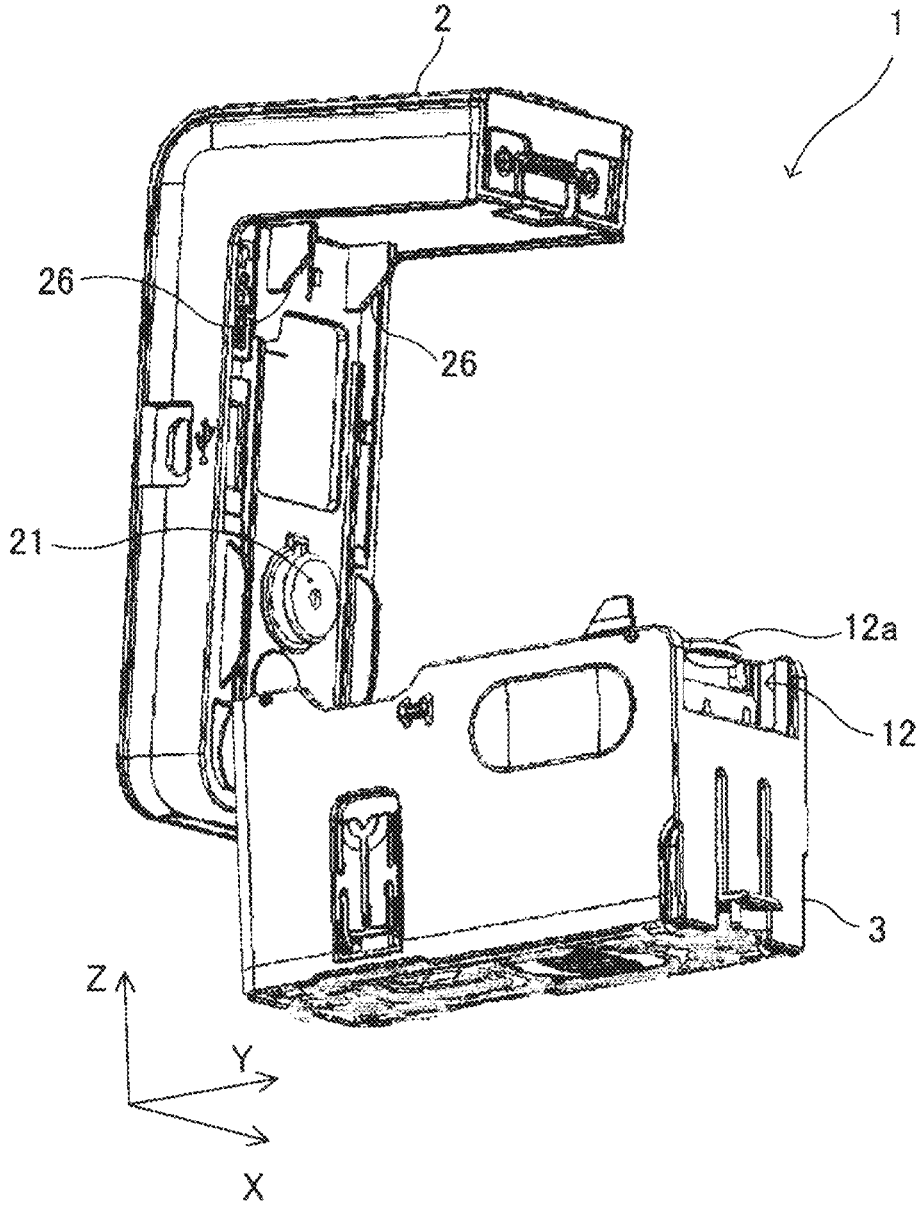
FIG. 31 is a perspective view of the handheld printer viewed from obliquely downward in a state where the upper unit is opened.
Figure 32:
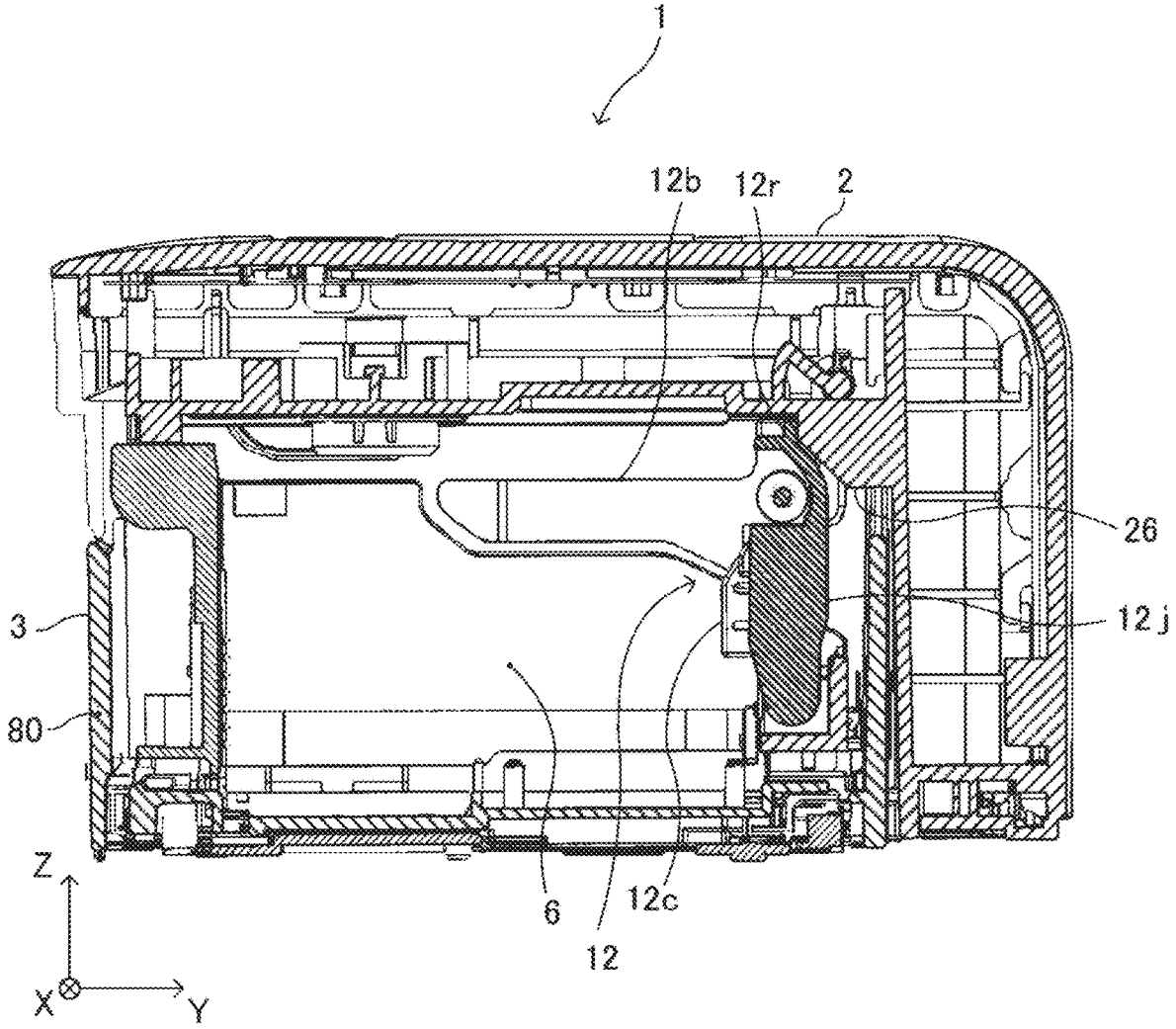
FIG. 32 is a cross-sectional view of the handheld printer with the ink cartridge removed in a state where the upper unit is closed.

FIG. 31 is a perspective view of the handheld printer 1 in a state in which the upper unit 2 is open with respect to the lower unit 3. FIG. 32 is a cross-sectional view of the handheld printer 1 in a state in which the ink cartridge 40 is removed and the upper unit 2 is closed. FIG. 32 illustrates a cross section at a position of an inner wall face of the wall on the left face 32 side (front side in FIG. 32) of the cartridge holder 6.

As illustrated in FIGS. 31 and 32, the handheld printer 1 includes the upper unit 2 which acts as a cover that covers a container to accommodate the ink cartridge 40 in the apparatus body. Further, inside the upper unit 2, the handheld printer 1 includes a movement restriction member 26. The movement restriction member 26 faces a surface on the front face 35 side of the upper end rib 12*r* (right side of FIG. 32) which is positioned in the direction in which the cartridge attaching and detaching mechanism 12 moves away to the separated position.

As the movement restriction member 26 is provided, after the upper unit 2 as a body cover is closed, it is possible to prevent the cartridge attaching and detaching mechanism 12 from moving to the separated position and the pressing force of the pressing portion 12*c* against the ink cartridge 40 is released. Thus, if any impact is applied to the handheld printer 1, such as when the user closes the upper unit 2, when the handheld printer 1 is carried, or the handheld printer 1 falls, reduction of the contact pressure of the cartridge-side contact 40*b* against the FPC contact 13 can be prevented. As a result, a proper connection state can be maintained. Even when some impact is applied to the handheld printer 1, occurrence of faulty power supply to the ink cartridge 40 can be prevented.

Variation

In the handheld printer 1 according to the above-described embodiment, the inclined face 12*g* is provided at a position where the cartridge attaching and detaching mechanism 12 contacts the ink cartridge 40. However, an inclined face can be provided at a position on the ink cartridge 40 side which contacts the cartridge attaching and detaching mechanism 12.

Figure 33:
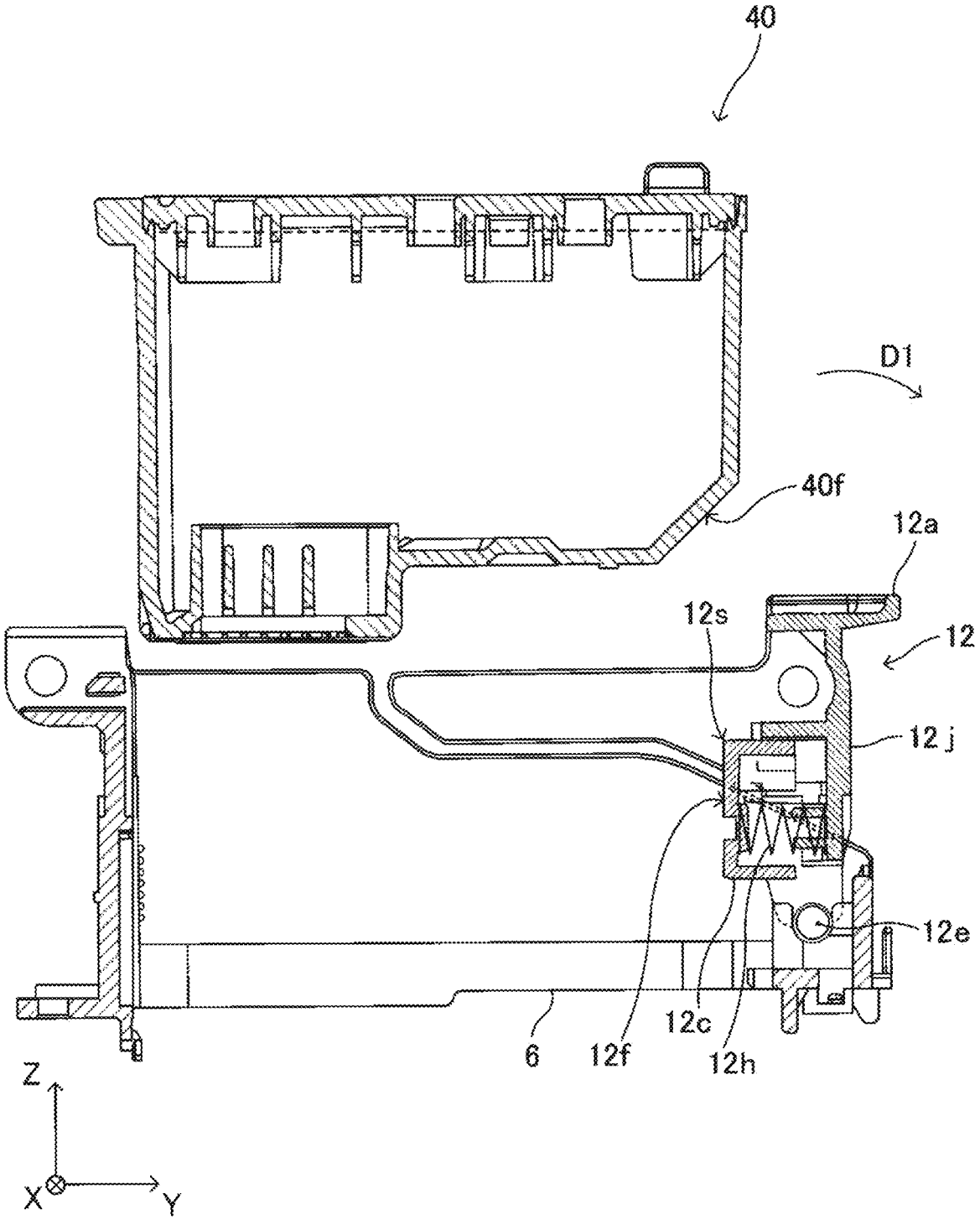
FIG. 33 is a cross-sectional view of the cartridge holder, the cartridge attaching and detaching mechanism and the ink cartridge of a handheld printer according to a variation.

FIG. 33 is a cross-sectional view of the cartridge holder 6 and the cartridge attaching and detaching mechanism 12 according to a variation of the handheld printer 1 in which a cartridge-side inclined face 40*f* is provided in a lower part of the ink cartridge 40.

As the ink cartridge 40 according to the variation, is inserted as illustrated in FIG. 33, an upper ridgeline portion 12*s* of the pressing portion 12*c* contacts the cartridge-side inclined face 40*f*. Further, when the ink cartridge 40 is inserted, the upper ridgeline portion 12*s* receives a force which moves the upper ridgeline portion 12*s* along the cartridge-side inclined face 40*f*, and the cartridge attaching and detaching mechanism 12 rotates around the attaching and detaching mechanism rotation shaft 12*e* in the direction as indicated by arrow D1 in FIG. 33. Therefore, similar to the above-described embodiment, it is possible to move the cartridge attaching and detaching mechanism 12 positioned at the connector-side position before the ink cartridge 40 is mounted, to the separated position by the mounting operation of the ink cartridge 40. Note that, similar to the upper end ridgeline portion of the pressing face 12*f* of the pressing portion 12*c*, a cartridge-side inclined face is not limited to a chamfered plane, but can be made as a round shape.

Although descriptions have been made above of the examples in which aspects of the present disclosure are applied to the inkjet handheld printer 1, the aspects of the present disclosure can also be applied to other types of image forming apparatuses. For example, the aspects of the present disclosure can be applied to a recording apparatus of, for example, thermal type or thermal-transfer type.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. An apparatus comprising:

an apparatus body having a space therein, the apparatus body including an apparatus body-side connector on a first inner wall face of the space;

an attachment unit configured to be removably mounted in the space within the apparatus body, the attachment unit including an attachment-side connector configured to be electrically connected to the apparatus body-side connector;

a pressing portion configured to press the attachment unit in a facing direction in which the attachment-side connector faces the apparatus body-side connector so as to press the attachment-side connector toward the apparatus body-side connector in a state where the attachment unit is attached to the apparatus body, the facing direction being orthogonal to a mounting direction of the attachment unit; and a movable member including the pressing portion and configured to rotate about a rotational shaft disposed on an opposite side of the space from the first inner wall face, and to move between a first position where the pressing portion is closest to the apparatus body-side connector and a second position where the pressing portion is farthest from the apparatus body-side connector.

2. The apparatus according to claim 1, wherein a distance between the pressing portion and apparatus body-side connector is shorter in a state where the attachment unit is not mounted in the apparatus body than in a state where the attachment unit is mounted in the apparatus body.

3. The apparatus according to claim 1, wherein the movable member is configured to move in a direction drawing away from the apparatus body-side connector by contact between the attachment unit and the pressing portion as the attachment unit is mounted in the apparatus body with the movable member positioned at the first position.

4. The apparatus according to claim 1, wherein a portion of the pressing portion configured to contact the attachment unit includes one of an inclined face and a round face inclined in the mounting direction of the attachment unit.

5. The apparatus according to claim 1, wherein a portion of the attachment unit configured to contact the pressing portion includes one of an inclined face and a round face inclined in the mounting direction of the attachment unit.

6. The apparatus according to claim 1, wherein the movable member includes a lever disposed to face the attachment unit and, wherein the lever is configured to face a downstream face of the attachment unit in the mounting direction when the movable member is at the first position, and wherein the lever is configured to move upstream in the mounting direction when the movable member moves away from the apparatus body-side connector.

7. The apparatus according to claim 1, wherein the rotational shaft is disposed in a vicinity of a downstream end, in the mounting direction, of the attachment unit mounted in the apparatus body.

8. The apparatus according to claim 1, wherein the movable member includes an orthogonal-direction horizontal portion extending in a direction orthogonal to the mounting direction of the attachment unit, and wherein the orthogonal-direction horizontal portion is disposed at an upstream end in the mounting direction of the attachment unit.

9. The apparatus according to claim 1, wherein the apparatus body includes a cover configured to cover a container to accommodate the attachment unit in the apparatus body, and wherein the cover includes a movement restriction member configured to restrict the movable member from moving from the first position to the second position with the cover being closed.

10. The apparatus according to claim 1, wherein the pressing portion is disposed on the opposite side of the space from the first inner wall face.

11. The apparatus according to claim 1, further comprising:

an operated portion rotatably attached to the apparatus body, wherein the operated portion is operated by a user when the user detaches the attachment unit from the apparatus body, wherein the pressing portion is configured to move in conjunction with rotation of the operated portion.

12. The apparatus according to claim 1, wherein the attachment unit includes a recording device configured to record an image on a recording medium.

13. The apparatus according to claim 12, wherein the apparatus is a handheld printer.

14. The apparatus according to claim 13, wherein the apparatus body of the handheld printer is configured to be held by a user to move the handheld printer in a scanning direction to form the image.

15. The apparatus according to claim 1, wherein the attachment-side connector is on a first surface of the attachment unit, and the pressing portion is configured to press the attachment-side connector toward the apparatus body-side connector by pressing a second surface of the attachment unit that is an opposite surface of the first surface.

16. An apparatus body having a space therein in which an attachment unit is removably mounted, the apparatus body comprising:

an attachment mount configured to house the attachment unit internally, the attachment mount including an apparatus body-side connector on a first inner wall face of the space, the apparatus body-side connector configured to be electrically connected with an attachment-side connector of the attachment unit;

a pressing portion configured to press the attachment-side connector of the attachment unit in a facing direction in which the attachment-side connector faces the apparatus body-side connector toward the apparatus body-side connector in a state where the attachment unit is attached to the apparatus body, the facing direction being orthogonal to a mounting direction of the attachment unit; and a movable member including the pressing portion and configured to rotate about a rotational shaft disposed on an opposite side of the space from the first inner wall face, and to move between a first position where the pressing portion is closest to the apparatus body-side connector and a second position where the pressing portion is farthest from the apparatus body-side connector.

17. The apparatus body according to claim 16, wherein the pressing portion is disposed on the opposite side of the space from the first inner wall face.

18. The apparatus body according to claim 16, further comprising:

an operated portion rotatably attached to the apparatus body, wherein the operated portion is operated by a user when the user detaches the attachment unit from the apparatus body, wherein the pressing portion is configured to move in conjunction with rotation of the operated portion.

19. The apparatus body according to claim 16, wherein the attachment unit includes a recording device configured to record an image on a recording medium.

20. The apparatus body according to claim 19, wherein the apparatus body is a body of a handheld printer.

21. The apparatus body according to claim 20, wherein the apparatus body of the handheld printer is configured to be held by a user to move the handheld printer in a scanning direction to form the image.

22. An apparatus comprising:

an apparatus body having a space therein, the apparatus body including an apparatus body-side connector on a first inner wall face of the space;

an attachment unit configured to be removably mounted in the space within the apparatus body, the attachment unit including an attachment-side connector configured to be electrically connected to the apparatus body-side connector;

a pressing portion configured to press the attachment unit in a facing direction in which the attachment-side connector faces the apparatus body-side connector in a state where the attachment unit is attached to the apparatus body, the facing direction being orthogonal to a mounting direction of the attachment unit; and a movable member including the pressing portion and configured to rotate about a rotational shaft disposed on an opposite side of the space from the first inner wall face, and to move between a first position where the pressing portion is closest to the apparatus body-side connector and a second position where the pressing portion is farthest from the apparatus body-side connector, wherein the pressing portion is disposed on the opposite side of the space from the first inner wall face.

* * * * *